US007610907B1

(12) United States Patent
Coray

(10) Patent No.: US 7,610,907 B1
(45) Date of Patent: Nov. 3, 2009

(54) PAINTBALL MARKER ACTION ASSEMBLY

(76) Inventor: Josh Coray, 1600 22nd St., #2, Bellingham, WA (US) 98225

( * ) Notice: Subject to any disclaimer, the term of this patent is extended or adjusted under 35 U.S.C. 154(b) by 75 days.

(21) Appl. No.: 11/614,324

(22) Filed: Dec. 21, 2006

Related U.S. Application Data

(60) Provisional application No. 60/753,594, filed on Dec. 22, 2005.

(51) Int. Cl.
*F41B 11/00* (2006.01)

(52) U.S. Cl. ..... 124/75; 124/73

(58) Field of Classification Search ..... 124/71–73
See application file for complete search history.

(56) References Cited

U.S. PATENT DOCUMENTS

| | | | | | |
|---|---|---|---|---|---|
| 4,616,622 | A * | 10/1986 | Milliman | 124/73 |
| 5,063,905 | A * | 11/1991 | Farrell | 124/72 |
| 5,333,594 | A * | 8/1994 | Robinson | 124/73 |
| 5,462,042 | A * | 10/1995 | Greenwell | 124/76 |
| 5,613,483 | A | 3/1997 | Lukas et al. | |
| 5,769,066 | A | 6/1998 | Schneider | |
| 5,967,133 | A | 10/1999 | Gardner, Jr. | |
| 6,003,504 | A * | 12/1999 | Rice et al. | 124/73 |
| 6,302,092 | B1 * | 10/2001 | Juan | 124/72 |
| 6,439,217 | B1 * | 8/2002 | Shih | 124/77 |
| 6,470,872 | B1 | 10/2002 | Tiberius et al. | |
| 6,553,983 | B1 * | 4/2003 | Li | 124/73 |
| 6,644,295 | B2 | 11/2003 | Jones | |
| 6,889,681 | B1 * | 5/2005 | Alexander et al. | 124/72 |
| 7,237,544 | B2 * | 7/2007 | Jones | 124/73 |
| 2001/0042543 | A1 * | 11/2001 | Perrone | 124/77 |
| 2003/0079731 | A1 * | 5/2003 | Dobbins | 124/76 |
| 2004/0244787 | A1 * | 12/2004 | Hsiao et al. | 124/73 |
| 2005/0115552 | A1 * | 6/2005 | Dobbins | 124/73 |
| 2005/0133014 | A1 * | 6/2005 | Jones | 124/73 |
| 2005/0193999 | A1 * | 9/2005 | Lai et al. | 124/71 |
| 2006/0037597 | A1 * | 2/2006 | Wood | 124/73 |
| 2006/0107939 | A1 * | 5/2006 | Dobbins | 124/73 |

* cited by examiner

*Primary Examiner*—Michael Carone
*Assistant Examiner*—Jonathan C Weber
(74) *Attorney, Agent, or Firm*—Michael F. Hughes; Hughes Law Firm, PLLC

(57) ABSTRACT

A paintball marking system comprising a bolt assembly and a spool assembly which are operationally arranged to move in conjunction with one another, whereby the changing of pressure of an actuating chamber of the spool assembly repositions the piston to allow communication of a dump chamber having compressed gas therein be released to the bolt assembly for accelerating a paintball.

24 Claims, 19 Drawing Sheets

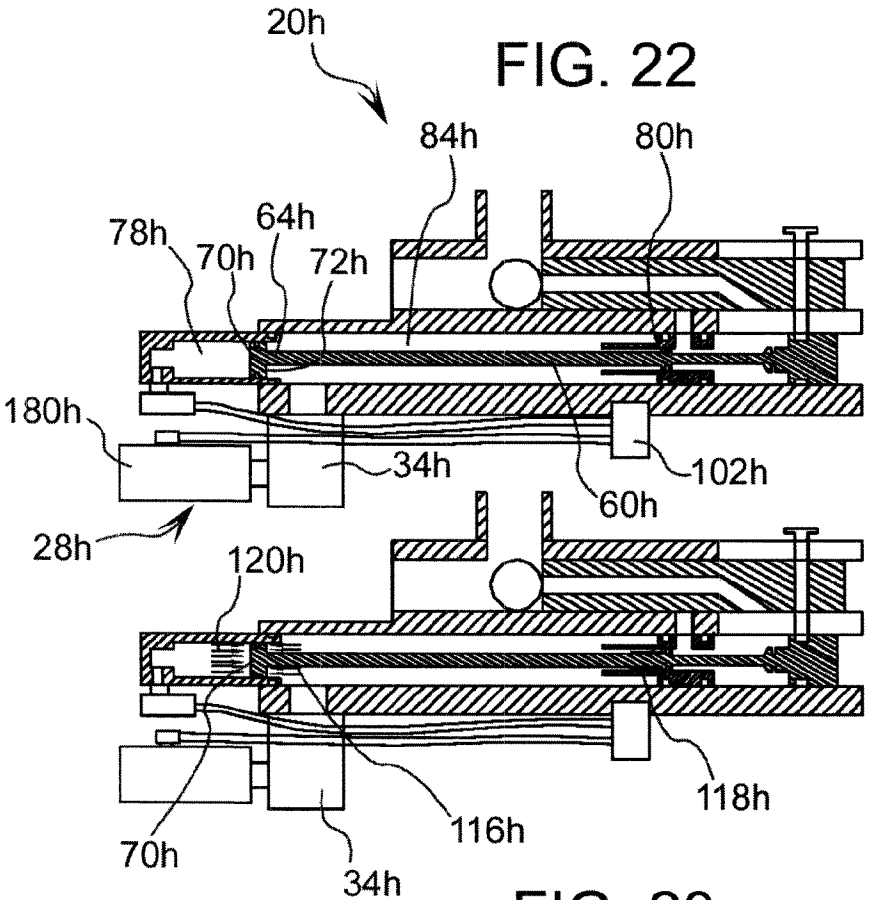
FIG. 22
FIG. 23
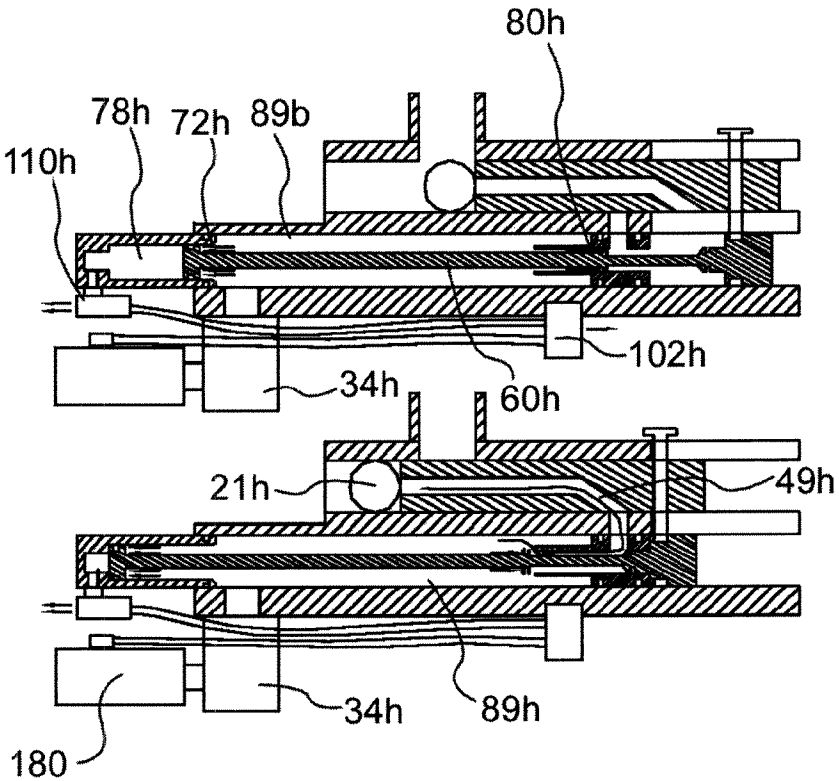
FIG. 24
FIG. 25

PAINTBALL MARKER ACTION ASSEMBLY

RELATED APPLICATIONS

This application claims priority benefit of U.S. Ser. No. 60/753,594, filed Dec. 22, 2005.

SUMMARY OF THE DISCLOSURE

Disclosed below is a paintball marker system operationally configured to fire a paint ball with pressurized gas from a pressurized gas source. The paintball marker system comprises a frame having a bolt assembly housing region and a spool assembly housing region. The frame further has a actuating chamber surface defining in part an actuating chamber.

A spool assembly is provided having a piston having an actuating ram and a valve ram. The actuator ram has an actuating ram chamber surface which in part defines the actuating chamber. The spool assembly further comprising a valve ram positioned within a valve body and having a valve ram dump surface. The valve ram dump surface is operatively arranged to be in communication with a high-pressure source.

A bolt assembly is provided comprising a bolt member having a paintball receiving location. The bolt assembly has a gas passage to communicate with pressurized gas from the dump chamber.

Further provided is a firing system comprising a trigger switch having a trigger line in communication with the actuating chamber.

The spool assembly and the bolt assembly are operatively arranged to move in conjunction with one another where the paintball marker system has a loading orientation where the paintball receiving location is orientated to allow a paintball to be positioned thereby and the bolt assembly does not have gas pressure from the pressurized gas source when in the loading orientation. The valve ram dump surface has a pressure effective surface area which has pressure applied thereto by the pressure within the dump chamber which is higher than atmospheric pressure. A change of pressure in the actuating chamber by changing the pressure within the trigger line by the trigger switch biases the piston from a loading orientation to a firing orientation where the valve ram is disengaged from the valve body and pressure from within the dump chamber is in communication with the gas passage of the bolt assembly to accelerate the paint ball. In the various embodiments the bolt assembly is not pressurized when in a loading orientation.

In one form the actuating ram has an actuating ram dump surface and where the actuating ram dump surface and the valve ram dump surface where the dump chamber define in part a dump chamber and the actuating ram dump surface and the valve ram dump surface have pressure effective surface areas which both have pressure applied thereto by the pressure within the dump chamber, which is higher than atmospheric pressure, and whereby a change of pressure in the actuating chamber biases the valve ram to disengaged from the valve body and pressure from within the dump chamber is in communication with the gas passage of the bolt assembly to accelerate the paint ball.

In another form the pressure affected surface area of the valve ram dump surface of the valve ram of the piston is less than the pressure affected surface area of the actuating ram dump surface of the actuating ram and when the paintball marker system is in a loading orientation, the actuating chamber is pressurized above atmospheric, and a trigger switch which is operated by a firing mechanism reduces the pressure within the actuating chamber to position the piston from the loading orientation to the firing orientation. In this form a further possible configuration is where the trigger switch is in communication with a trigger line which is connected to a quick release valve interposed between the actuating chamber and the trigger line, whereby when the trigger line reduces pressure, the quick release valve dumps the compressed air within the actuating chamber at an accelerated rate. The quick release valve can dump the air through the actuating chamber from the high-pressure state to substantially atmospheric pressure at less than 1/10th of a second and in many cases much faster.

The bolt assembly and the spool assembly can be positioned longitudinally rearward with respect to the frame when in a loading orientation, and the bolt assembly and the spool assembly are positioned in a longitudinally forward position when in a firing orientation. In one form the dump chamber is not sealed from the pressurized gas source when the spool assembly is in a firing orientation. Further, a high pressure source communication line can be positioned in a forward region of the frame and the piston further comprises a cut-off ram which is properly configured to engage a cut-off tube to isolate the dump chamber from the high-pressure source when the piston is in a firing orientation.

The actuating chamber in one form is at a first low pressure when in the loading orientation, and the trigger switch is optimally configured to pressurize the actuating chamber to a second high pressure whereby the second high pressure multiplied by the actuating chamber surface of the actuating ram is greater than the valve ram dump surface of the valve ram of the piston multiplied by the dump chamber pressure to reposition the ram from the loading orientation to the firing orientation. In this form the second high pressure within the actuating chamber can be substantially the same as the pressure within the dump chamber.

The valve ram in another form extends beyond a chute region of the valve body be on a chute lip to allow communication between the dump chamber at a frame passageway interposed between the bolt assembly and the spool assembly, which provides communication of compressed gas within the dump chamber to the gas passageway of the bolt.

In one embodiment the actuating ram dump surface of the actuating ram of the piston multiplied by the pressure within the dump chamber in a loading orientation is greater than the sum of a pressure effective surface area of the valve ram dump surface of the valve ram and the actuating chamber surface of the actuating ram multiplied by a loading orientation high pressure within the actuating chamber. The paintball marker system can have the loading orientation high pressure is substantially the same as the dump chamber with a loading orientation. In another form the loading orientation high pressure is less than the pressure within the dump chamber in a loading orientation where further the loading orientation high pressure of the actuating ram when in a loading orientation can be less than one half of the pressure within the dump chamber when in a loading orientation, and a pressure regulating valve maintains the loading orientation high pressure and the pressure regulating valve is in communication with the high pressure source.

As described in a few embodiments herein the bolt assembly and the spool assembly are operatively arranged to move in conjunction with one another from the loading orientation to the firing orientation where the bolt assembly moves longitudinally forwardly and the spool moves longitudinally rearwardly. One possible form of this action is to have the bolt assembly and the spool assembly are operatively arranged to move in conjunction with one another whereby a transfer gear translates forward movement in the piston with rearward movement of the bolt.

The paintball marker system has in one form the bolt assembly and the spool assembly are operatively arranged to move in conjunction with one another where as the actuating chamber repositions by way of pressure differential of the piston from the loading orientation to the firing orientation by displacing the piston in a longitudinal direction, a bolt pin engaged within a torque slot defined by a slot surface on the bolt rotates a ball receiving location which is in communication with a feed chamber when in the loading orientation, to a rotated position where the ball receiving location of the bolt is cut off in communication from the feed chamber when in a firing orientation, and pressure from the dump chamber is directed to the gas passageway of the bolt member.

In another embodiment a second actuating chamber is in communication with a second actuating chamber ram and the trigger switch is operatively configured to direct pressure to the first actuating chamber to reposition the piston from the loading orientation to the firing orientation. The second actuating chamber has a loading orientation pressure which is higher than atmospheric pressure and this pressure is released at the substantially same time as the pressure within the first actuating chamber is increased to reposition the piston from the loading orientation to the firing orientation. In this form a second actuating ram dump surface can have a pressure effective surface area that is substantially the same as the valve ram dump surface. Further, the second actuating ram can have a second actuating ram chamber surface that has a substantially similar pressure effective surface area as the actuating ram chamber surface of the actuating ram.

Further taught herein is a method of accelerating a paintball comprising the steps positioning a paintball adjacent to a paintball receiving location of a bolt member and having the bolt member positioned in a loading orientation. Then operatively connecting the bolt member to a piston having a valve ram and an actuating ram whereby the piston and bolt member move in conjunction with one another from a loading orientation to a firing orientation, the bolt member in part defining a dump chamber.

Then positioning the actuating ram within an actuating chamber and having a trigger system alter the pressure within the actuating chamber to create a pressure surface area differential between the actuating chamber and the dump chamber to bias the piston from the loading orientation to the firing orientation, which repositions the bolt member from the loading orientation to the firing orientation whereby pressurized gas is directed to the bolt member during the firing orientation and pressurized gas is not present in the bolt member when in the loaded orientation.

The method cited above can have the actuating chamber at atmospheric pressure during the loading orientation, and the trigger system pressurizes the actuating chamber where the pressure acting upon the actuating ram of the piston is sufficient to reposition the piston to a firing orientation.

Alternatively the method can have the actuating chamber is at a first high pressure when a loading orientation and the triggering system releases the pressure in the actuating chamber to reposition the piston to a firing orientation which repositions the bolt member to a firing orientation.

Of course other features of the various designs can be appreciated in the detailed description of various examples within the disclosure below.

BRIEF DESCRIPTION OF THE DRAWINGS

FIGS. 22-25 show progressive views of another embodiment where a low pressure regulator maintains a lower first pressure within the actuating chamber in the progressive views show the system transitioning to a firing orientation;

DESCRIPTION OF THE PREFERRED EMBODIMENTS

Figure 1:
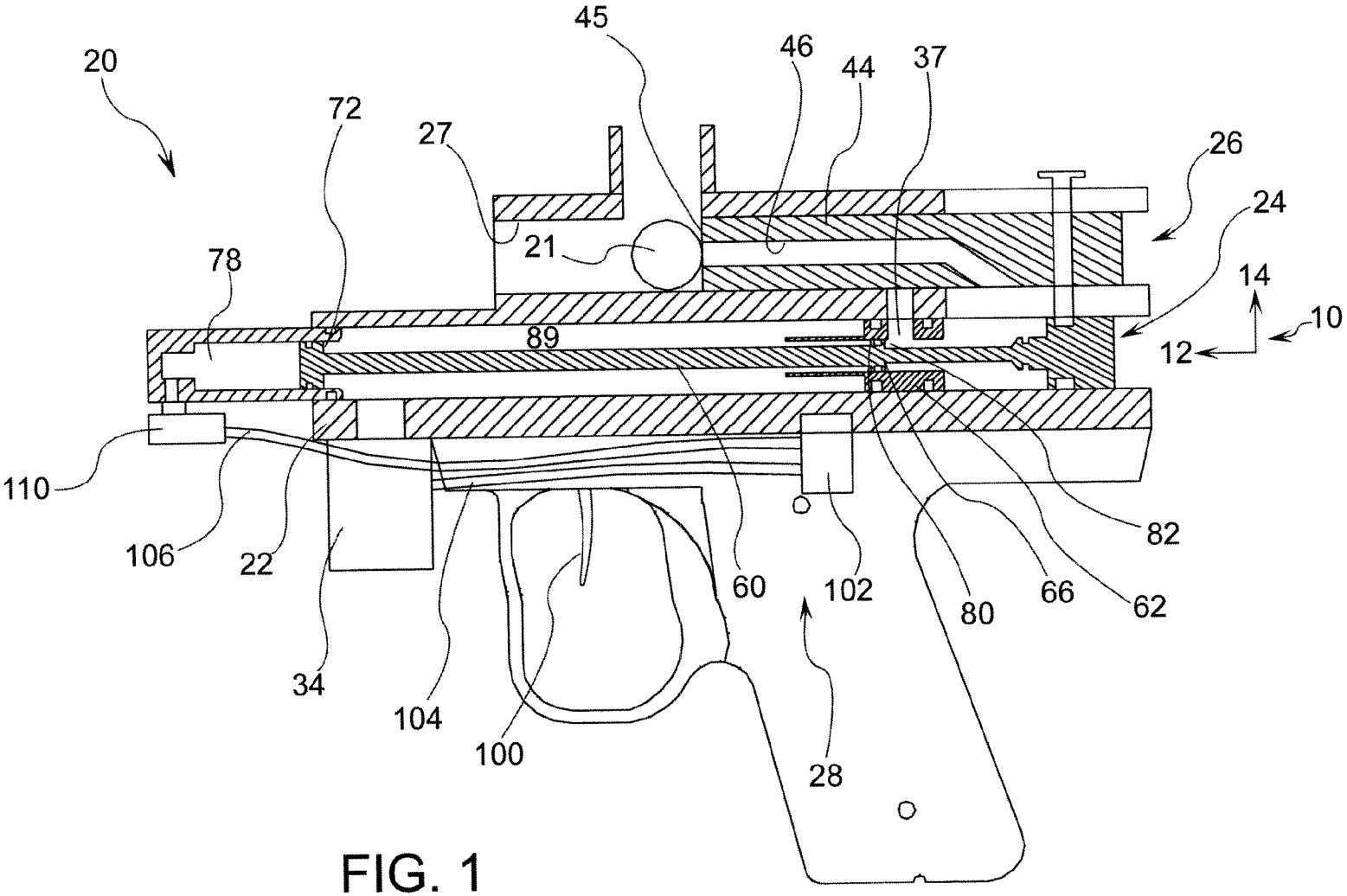
FIG. 1 shows a side profile partial sectional view of the paintball marking system when the bolt assembly and the spool assembly are in a loading orientation.

As shown in FIG. 1, there is a paintball marking system 20 configured to accelerate and fire a paintball/projectile 21. Before going into further detail on the various components, there will first be a description of an axis system 10. As shown in FIG. 1, the axis 12 indicates a longitudinal direction and points in a forward direction with respect to the frame 22 of the paintball marking system 20. The axis 14 indicates a vertical direction. Of course, the system 20 can be arranged in a multitude of orientations, and the vertical direction is for general description of the various components. Further, substantially perpendicular to the axes 12 and 14 is a lateral direction.

Referring now to the general components of the paintball marking system 20, there is a frame 22, a spool assembly 24, a bolt assembly 26, and a trigger system 28.

Figure 2:
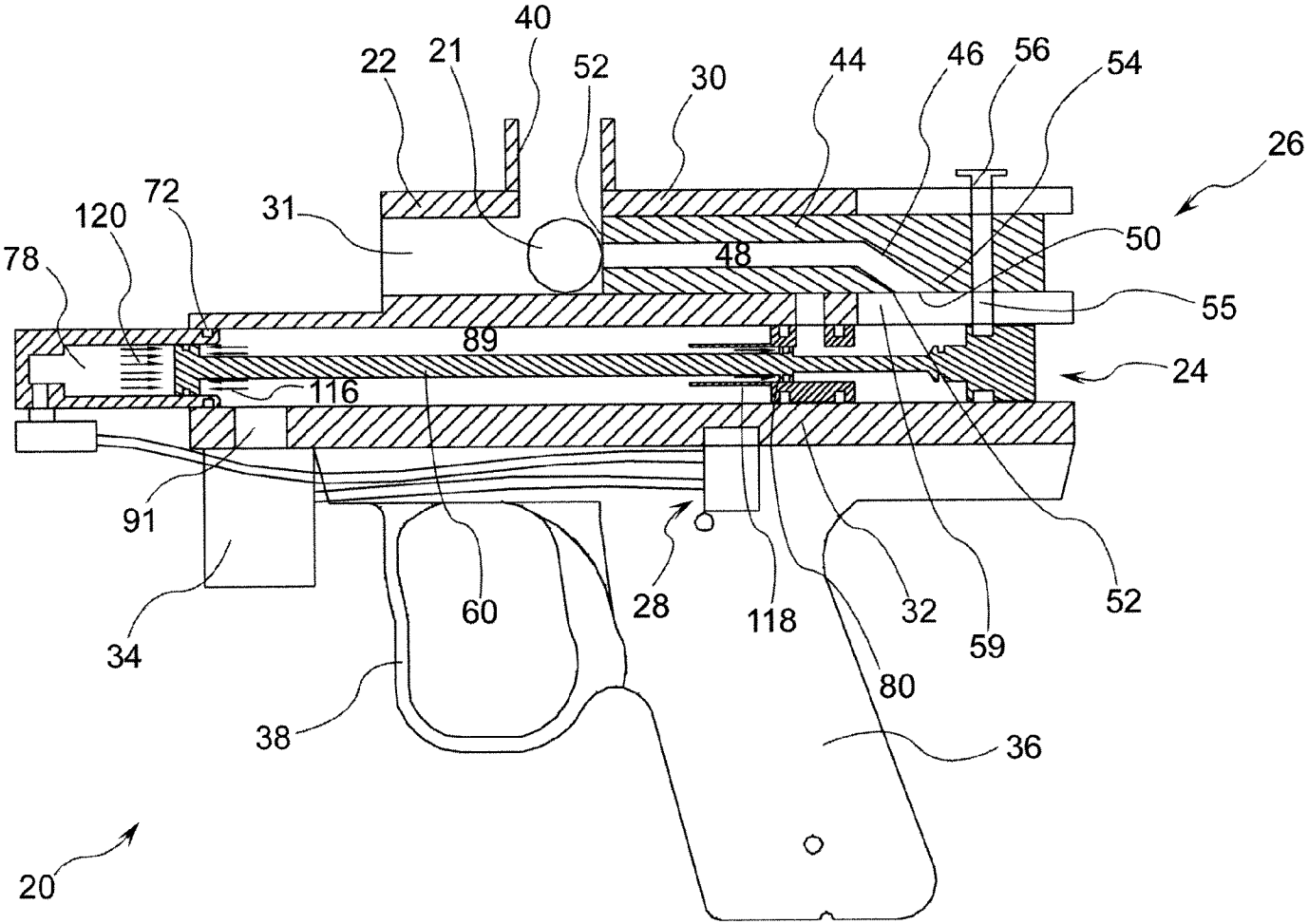
FIG. 2 shows the paintball marking system illustrating the pressure vectors active on the piston.
Figure 4:
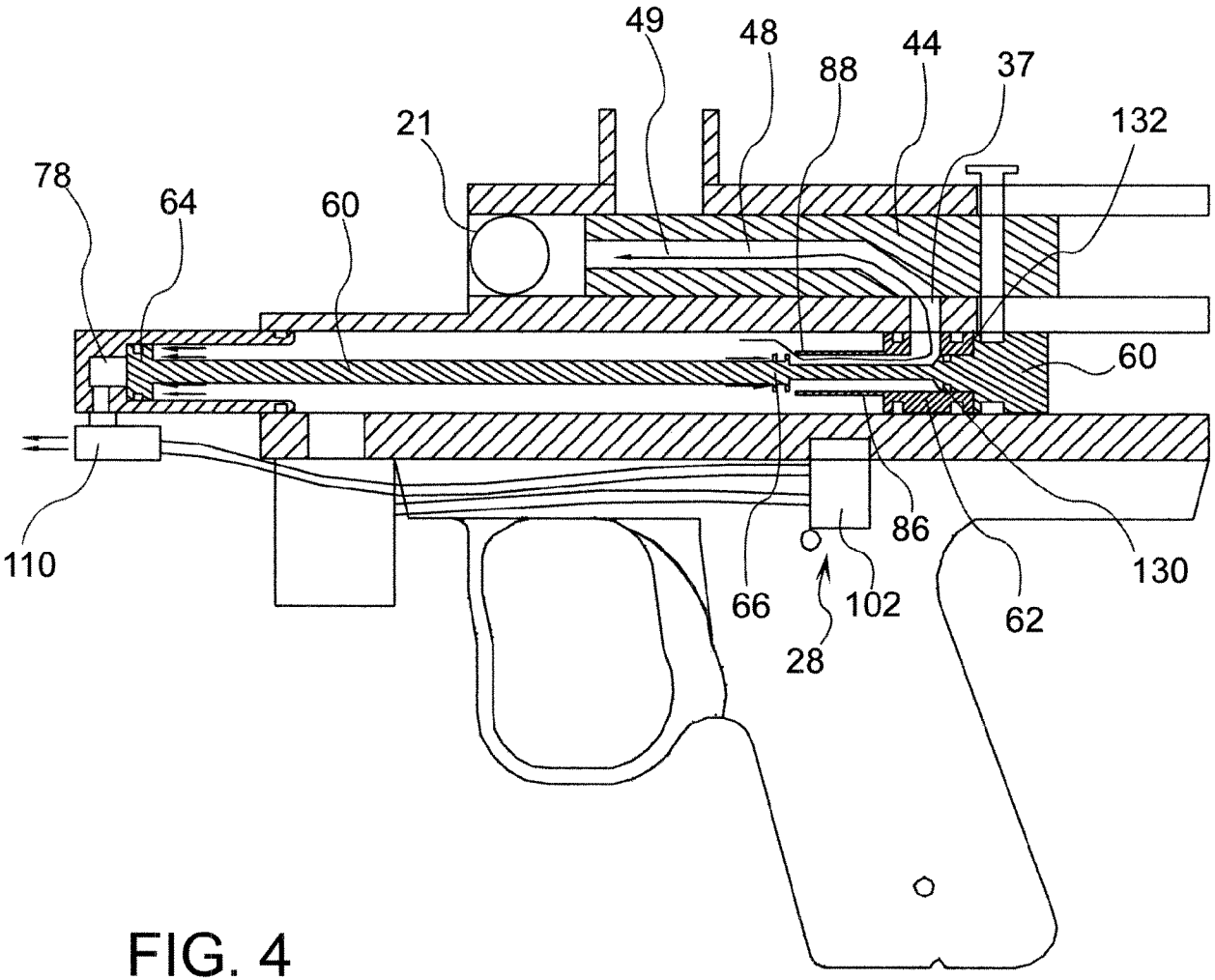
FIG. 4 shows the system in a firing orientation.

Before engaging in a detailed discussion, there will be a general description of the basic operation of the paintball marking system 20, such that shown in FIG. 1. It should be noted that there are various embodiments described herein showing, by way of example, various possible teachings of the claimed apparatus. Of course other variations and components of the various embodiments can be combined to provide a multitude of options for constructing the system 20. In general, as shown in FIG. 1, the paintball marking system 20 comprises the spool assembly 24 and the bolt assembly 26, which are operatively arranged to move in conjunction with one another from the loading position as shown in FIG. 1 to a dynamic firing position as shown in FIG. 4 and back to the loading position. As shown by the various embodiments herein, the actuating chamber 78 alters in pressure whereby pressure differential within the dump chamber 89 biases the piston 60 to the firing orientation. As shown in FIG. 2, the frame 22 can be of a unitary design or comprised of multiple connected components. The upper portion of the frame has a bolt housing region 30 which houses the firing tube 31 and the bolt member 44 described further herein when describing the bolt assembly 26. In one form, positioned below the bolt housing region 30 is a spool housing region 32, which in general houses the spool assembly 24 described further herein. Further, the frame 22 has a compressed gas receiving area 34 which is operatively configured to mount a compressed gas tank thereto. In general, the compressed air can be from a variety of sources which are well-known in the art. The frame 22 further comprises a handle region 36, and other various areas such as a trigger guard 38. Of course, the frame as noted above can be comprised of separate components which are interchangeable. One form of a frame is shown in the various figures and other alternative forms can be provided. Of course, the frame is defined broadly and could take various forms of which could be beyond that of a handheld gun and, for example, could be a basic type of structure which could be attached to a sensory robot or some other type of fixture for purposes of the firing of paintballs.

Referring now to the bolt housing region 30, a feed chamber 40 is provided, which can be communication with a plurality of projectiles 21. In general, the projectiles 21 are paintballs, and in one form, 68 caliber paint balls which are common in the art. Of course, other forms of a projectile and other calibers can be utilized with the basic teachings within this specification. In general, the frame passageway 37 is adjacent to the connector slot 39.

As shown in FIG. 1, the bolt assembly comprises a bolt member 44. The bolt member 44 has a paintball receiving location 45 and is slidably connected to the bolt housing region 30 of the frame 22. As shown in, for example, FIGS. 3 and 4, the bolt member 44 is configured to reposition from a loading orientation as shown in FIG. 2, to a firing orientation as shown in FIG. 4. The bolt member comprises a gas passageway surface 46 defining the gas passageway 48. In general, the gas passageway has the gas receiving opening 50 having the forward portion 52 and the trailing portion 54. The gas passageway 48 further has the exit region 52 which is configured to disperse compressed gas therethrough to project the projectile 21 down the firing tube 31. The bolt member 44 further utilizes an interface region 55, which as shown in FIGS. 1-4 is a connector pin 56 which allows the bolt assembly 26 to move in conjunction with the spool assembly 24.

As described in further detail herein when discussing other alternative embodiments, the bolt assembly 26 is operationally arranged to move in conjunction with the spool assembly 24 and vice versa. As shown in FIGS. 1-4, for example, both of these units move in the same direction from the loading orientation (as shown in FIG. 1) to the firing orientation as shown in FIG. 4. Now referring to FIG. 3, the spool assembly 24 is positioned within the spool housing region 32 of the frame 22. In general, the spool assembly 24 comprises a piston 60. In one form, a valve housing 62 is utilized. In general, the piston 60 comprises an actuating ram 64 and a valve ram 66. Further, the piston 60 comprises a bolt connection region 68.

Figure 3:
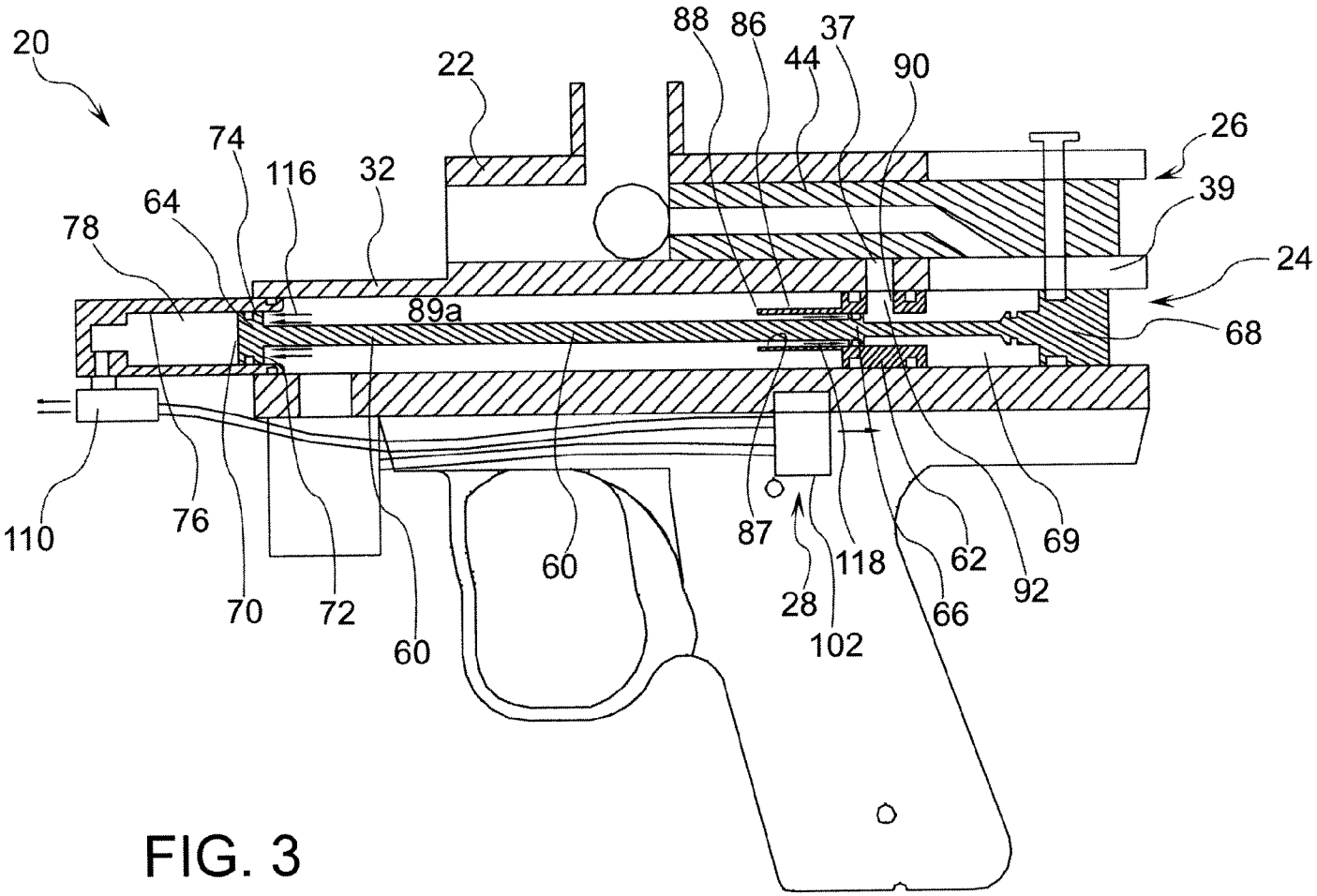
FIG. 3 shows the paintball marking system transitioning to a firing orientation where the pressure within the actuating chamber is lowered.

Still referring to FIG. 3, the actuating ram 64 comprises an actuating ram chamber surface 70 and an actuating ram dump surface 72. In general, each of the rams has an annular groove, such as that shown at 74 for the actuating ram 64, to provide a seal to the actuating chamber surface 76.

An actuating chamber 78 is defined in part by the actuating chamber surface 76 and the actuating ram chamber surface 70. As described further herein, the actuating chamber 78 alters in pressure to bias the piston 60 from the loading orientation such as that as shown in FIG. 1 to the firing orientation as shown in FIG. 4. Of course, presented throughout the specification are various other embodiments of the paintball marking system utilizing pressures in a variety of manners to alter the orientation of the components from the loading to the firing positions.

Referring now to FIG. 1, the valve ram dump surface 80 is shown, and on the imposing portion of the valve ram 66 is the valve ram release surface 82. The valve ram is positioned within the valve housing 62 where the valve housing 62 has the chute region 86, the chute surface 87, and the chute lip 88 (see FIG. 3). The valve housing 62 further has the surface 90 defining the passageway 92, which is in communication with the frame passageway 37.

With the foregoing description in place, it can be appreciated that the dump chamber 89 is defined in part by the frame 22 as well as the actuating ram dump surface 72 and the valve ram dump surface 80. In the embodiment as shown in FIGS. 1-4, the surface area of the actuating ram dump surface 72 is greater than the surface area of the valve ram dump surface 80. In other words, the affected surface areas which have pressure acting thereon from the internal pressure of the dump chamber 89 is referred to as the pressure-affected surface area, which is the amount of perpendicular surface area with respect to the direction of travel of the piston 60. As shown in FIGS. 1-4, it can be appreciated that the pressure affected surface area of the surface 80 is less than the pressure affected surface area of the surface 72. Therefore, the actuating chamber surface 76 is of a greater diameter (assuming the rams are cylindrical) than the chute surface 87. Therefore, if the pressures in the connector travel region 69 and the actuating chamber 78 are equal, it can be appreciated how the piston 60 would travel longitudinally forwardly as described further herein.

There will now be a description of the trigger system 28, followed by a more detailed description of the operation of the paintball marking system 20 with specific discussion of the various pressure differentials and pressure affected surface areas which operate the firing mechanism.

Figure 21:
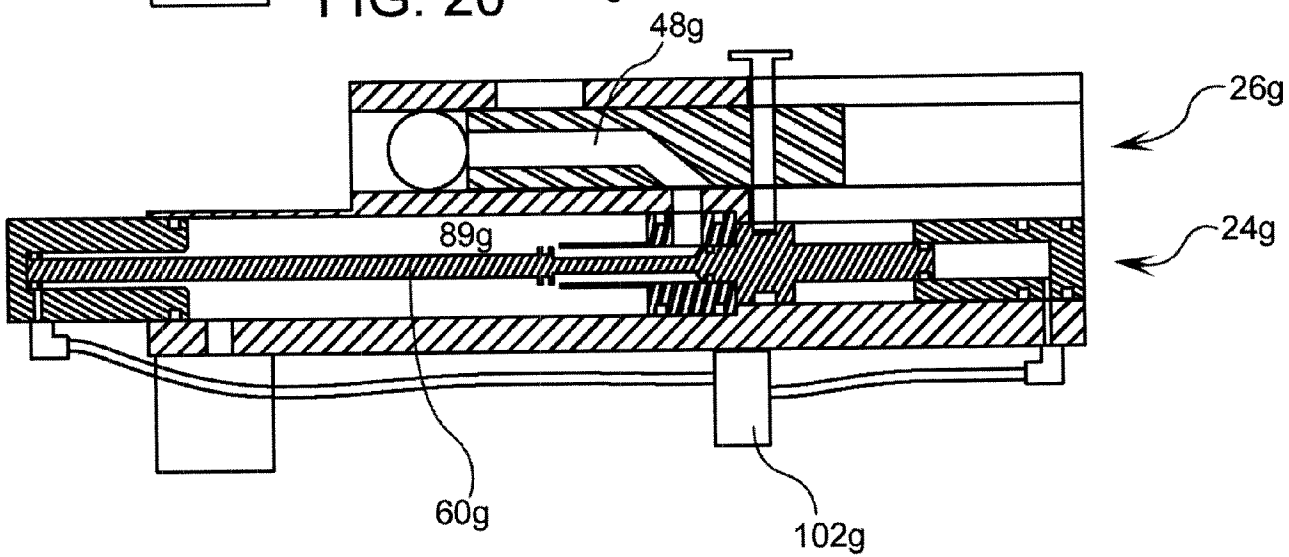
FIG. 21 shows the actuating chambers orientating the spool and bolt member to a firing orientation.

As shown in FIG. 21, the trigger system 28 comprises in one form a firing mechanism/trigger 100 which in one form is a conventional trigger which can be pivotally or slidably attached to the frame 22. The trigger 100 is configured to operate the trigger switch 102. The trigger switch 102 operates to alter the pressure within the actuating chamber 78, which biases the piston 60 of the loading orientation to the firing orientation as described further herein. As shown in FIG. 1, the trigger switch 102 has a high-pressure line 104 which is in communication with the high-pressure source (not shown). The trigger line 106 is in communication with the actuating chamber 78. It should be noted that there are various embodiments which either pressurize the actuating chamber 78 or depressurize the actuating chamber 78 to operate the piston 60. In one form, interposed between the trigger 106 and the actuating chamber 78 is a quick-release valve 110. In general, the trigger switch 102 through the trigger line 106 can activate the quick-release valve 110 in the embodiment is shown in FIGS. 1-4, which rapidly releases the pressure within the actuating chamber 78. A product common in the art is the quick exhaust valve (QEV), which basically relies upon a pressure within the trigger line 106 to provide pressure therein to maintain pressure within the actuating chamber 78. However, the internal mechanism is such that when the pressure begins to decrease within the trigger line 106, an internal component shifts to allow exhaust of the actuating chamber at a rapid pace, which actually occurs right on the quick-release valve 110.

In one form, by lowering the pressure within the trigger line 106, an internal mechanism within the quick-release valve 110 immediately dumps the pressurized gas within the actuating chamber, thereby of rapidly reducing the pressure therein.

With the foregoing technical description in place, there will now be a detailed discussion of the operation of the paintball marking system 20, in one form with initial reference to FIGS. 1-4.

As shown in FIG. 1, the paintball marking system is in a loaded orientation. A paintball projectile 21 is adjacent to the paintball receiving location 45 of the bolt member 44. This can be considered a resting position, and it should be noted that the bolt assembly 26 is not pressurized and does not have any chamber therein which is under pressure.

In this loading orientation or resting state, the actuating chamber 78 is pressurized in one form to the pressure of the high-pressure source (not shown), which is attached to the compressed gas receiving area 34. Referring now to FIG. 2, there is schematically shown, by way of the vector arrows, the pressure within the dump chamber 89, which is in communication with the high-pressure source by way of the high-pressure opening 91 to the compressed gas receiving area 34. The pressure vectors 116 and 118 in FIG. 3 and FIG. 2 schematically indicate the pressure differential force acted upon the piston 60. However, because the pressure affected surface area of the valve ram dump surface 80 is less than the pressure affected surface area of the actuating ram dump surface 72, there is a longitudinally forward thrust upon the piston 60. However, because the actuating chamber 78 is under pressure as indicated by the pressure vectors 120, the piston 60 is maintained in the longitudinally rearward direction, which for this embodiment is the loading orientation.

Now referring to FIG. 3, it can be appreciated that the trigger switch 102 has been activated and the quick-release valve 110 rapidly vents the compressed gas within the actuating chamber 78. Therefore, the pressure vectors 116, which are greater than the pressure vectors 118, now bias the piston 60 from the loading orientation to the firing orientation, which is longitudinally forward (to the left) in FIG. 3.

Now referring to FIG. 4, it can be appreciated how the gas within the actuating chamber has been vented through the quick-release valve 110, and further, the actuating ram 64 has now positively displaced the gas contained therein, which has exited to the surrounding atmosphere. Because the connector travel region 69 is under ambient pressure, and the actuating chamber 78 to fire the gun is under ambient pressure, the piston 60 is thrust forward and the valve ram 66 extends beyond the chute lip 88, thereby as shown by arrow 49 allowing gas to pass through the chute region 86 of the valve housing 62 and bypass the frame passageway 37 to the gas passageway 48 of the bolt 44. It should be noted that the release of the gas to the dump chamber 89 can be, in one form, where the valve ram 66 passes beyond the chute lip 88, or alternatively when the forward portion 52 of the gas receiving opening 50 on the bolt 44 is in communication with the frame passageway 37.

After a short amount of time, the trigger switch 102 re-pressurizes the chamber 78 by administering gas from the high-pressure source connected at the compressed gas receiving area 34 through the high-pressure line 104, and re-pressurizes through the trigger line 106. The quick-release valve 110 operates when pressure is re-applied thereto to supply the pressure to the actuating chamber 78 to returned the piston in a longitudinally rearward direction back to the position shown in FIG. 1.

Still referring to FIG. 4, the piston 60 further comprises a firing ramp seal 130 which engages the chute region 132 so the gas within the dump chamber 89 does not leak to the surrounding atmosphere, but rather is directed to the gas passage 48 of the bolt member 44.

Figure 5:
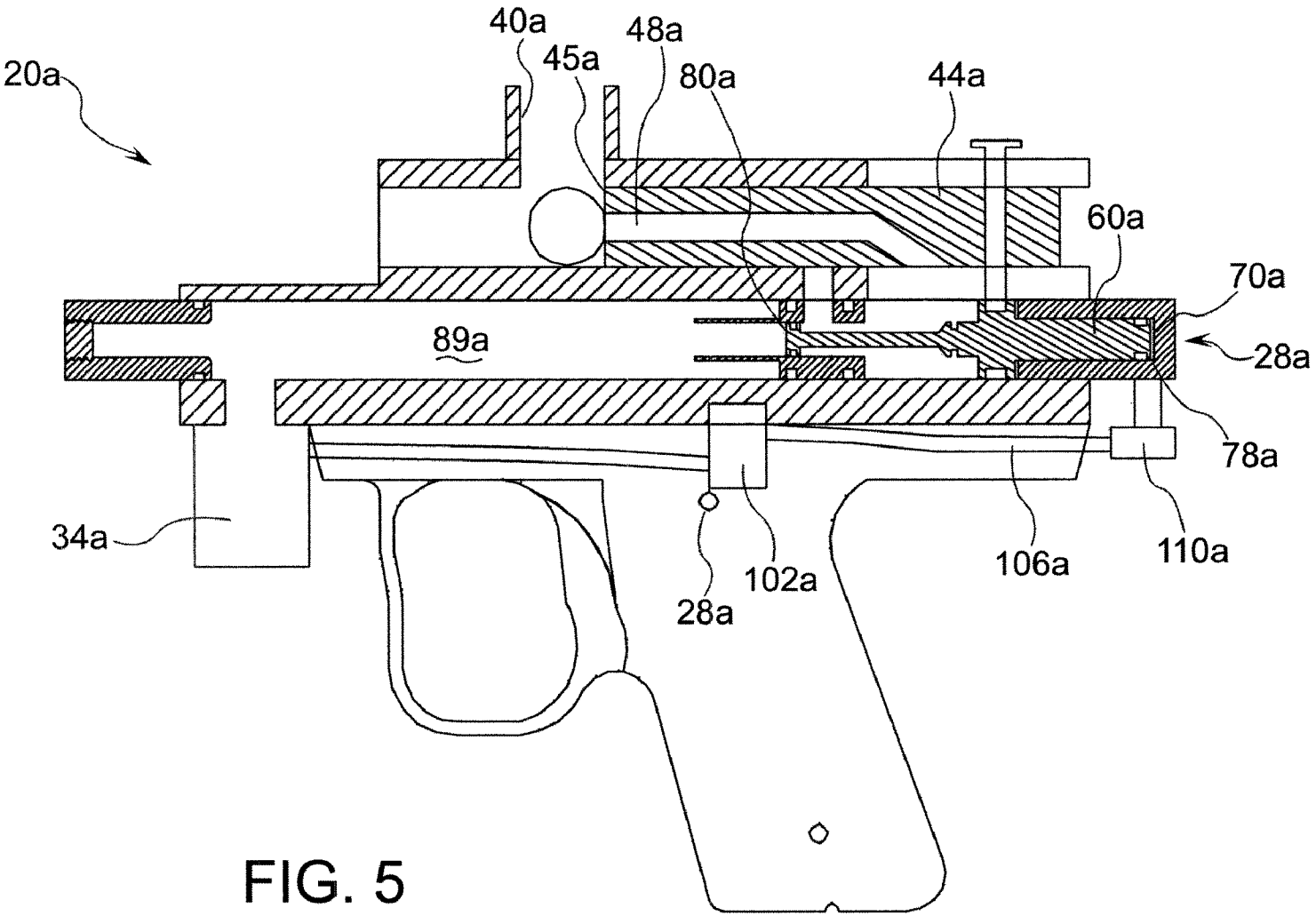
FIG. 5 shows another embodiment of the paintball marking system in a loading orientation.

The foregoing describes a first embodiment of the disclosure. Where possible, similar numeric designations will designate similar components of the above embodiment, but will be followed by an alpha character (e.g. a, b, c, etc.). There will now be a description of a second embodiment with reference to FIGS. 5-8. As shown in FIG. 5, the paintball firing assembly **20*a* is shown in a loading orientation where the piston 60 is positioned within the actuating chamber 78*a*. In this form, the pressure within the actuating chamber 78*a* is at a first low pressure. In one form, this first low pressure is substantially near atmospheric pressure. Therefore, the actuating ram chamber surface 70*a* multiplied by the pressure in the actuating chamber 78 is less than the valve ram dump surface 80 multiplied by the pressure within the dump chamber 89*a*. In one form, the dump chamber 89*a* is in constant communication with the high-pressure source (not shown), which is connected at the compressed gas receiving area 34*a***.

Figure 6:
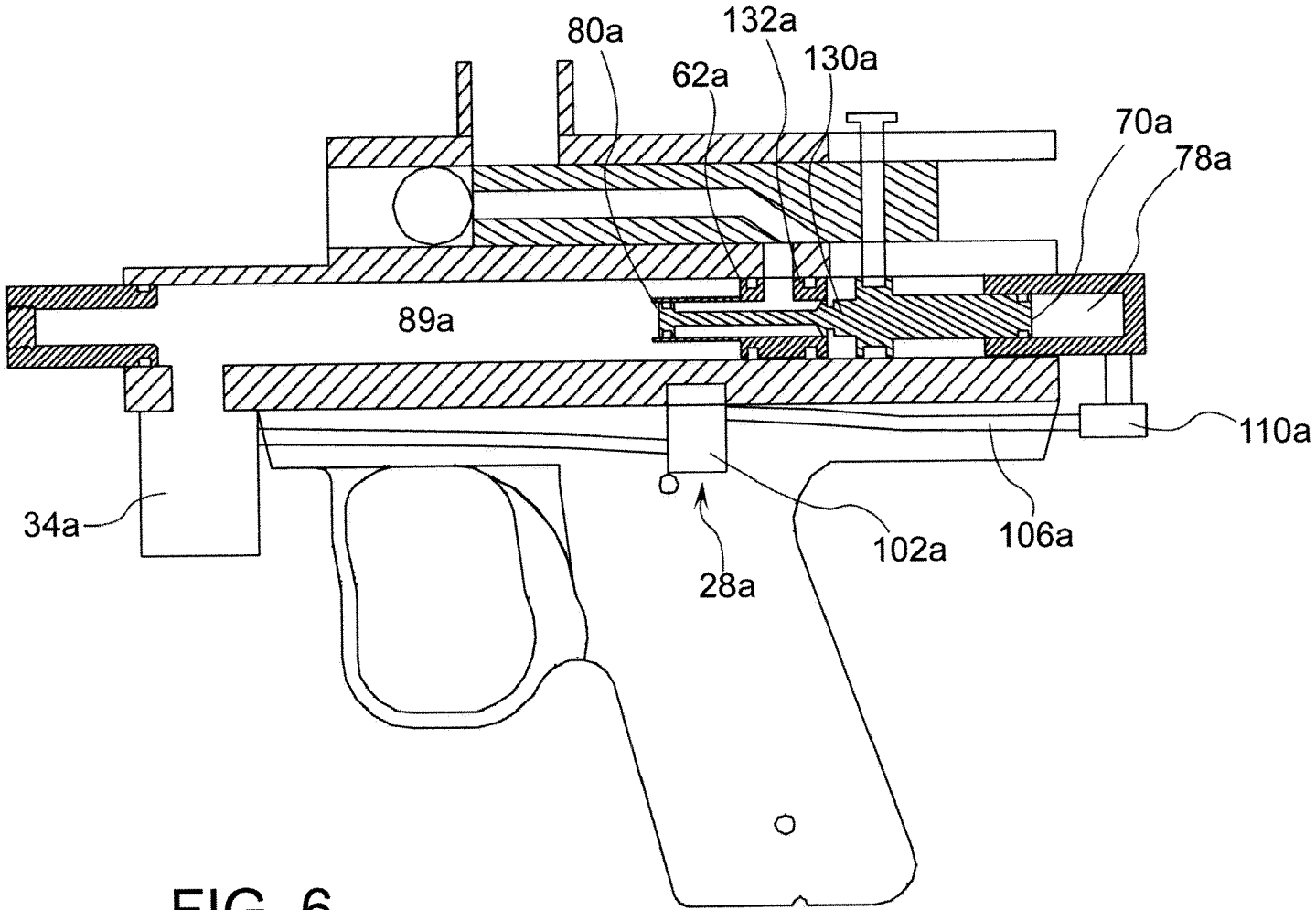
FIG. 6 shows the system transitioning to a firing orientation.
Figure 7:
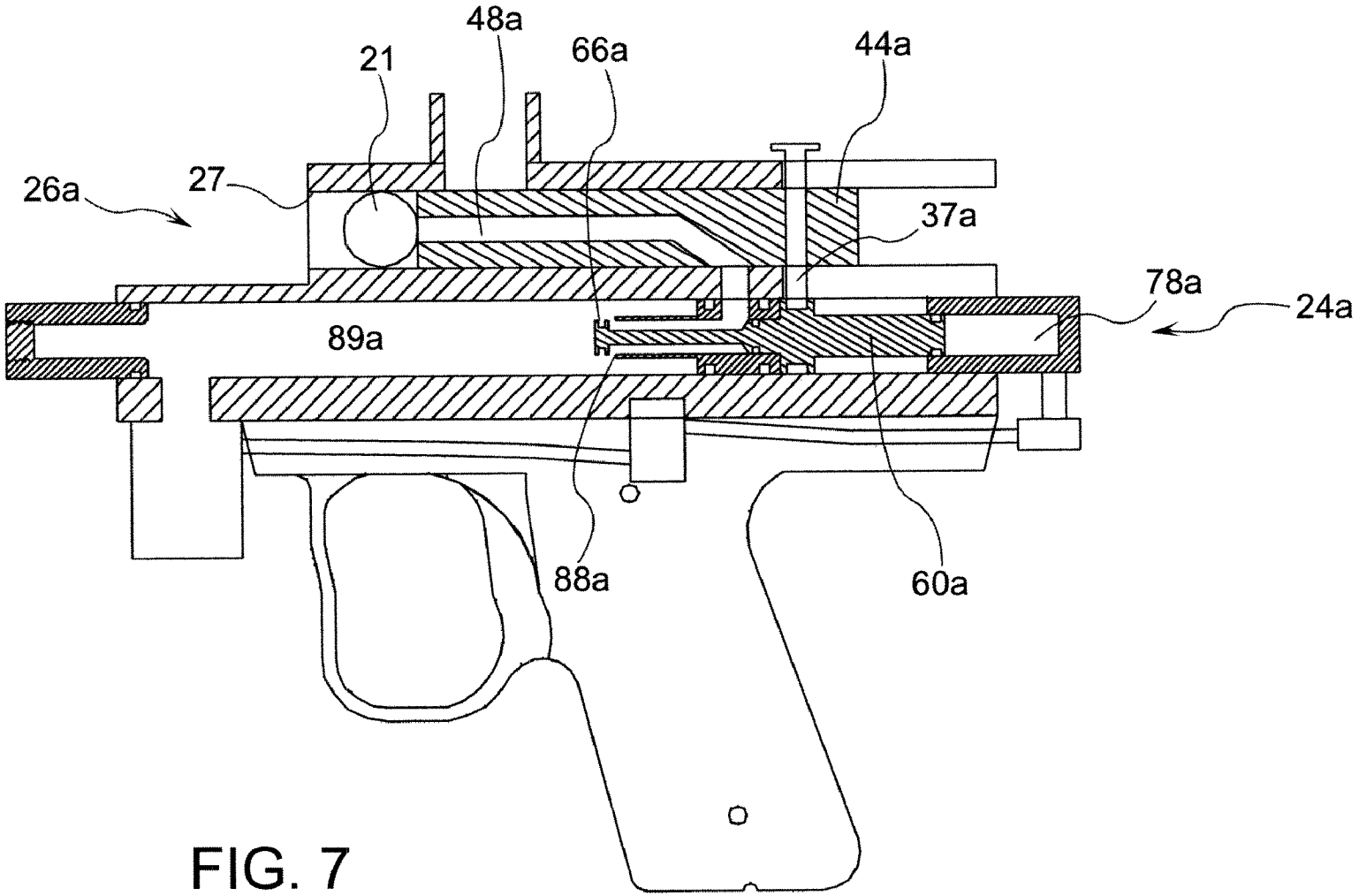
FIG. 7 shows the system in a firing orientation.

Now referring to FIG. 6, it can be appreciated that the actuating chamber **78*a* is moving from the loading orientation toward a firing orientation where the trigger system 28 has been activated, and the trigger switch 102*a* is now supplying pressure to the trigger line 106*a*. As is further shown in FIG. 6, the firing ram seal 130*a* is engaging the chute region 132*a* of the valve body 62*a*. Now referring to FIG. 7, it can be appreciated that the valve ram 66*a* has disengaged from the chute lip 88*a*, and the dump chamber 89*a* is now in communication with the frame passageway 37*a*, as well as the gas passageway 48*a* of the bolt 44*a*. In this firing orientation, it should be noted that the motion of the piston 60*a* as well as the bolt member 44*a* is rather dynamic where the dump chamber 89*a* is in brief communication with the gas passageway 48*a* of the bolt member 44*a* to project the projectile 21 down of the barrel portion 27** which is shown in part throughout the figures.

Figure 8:
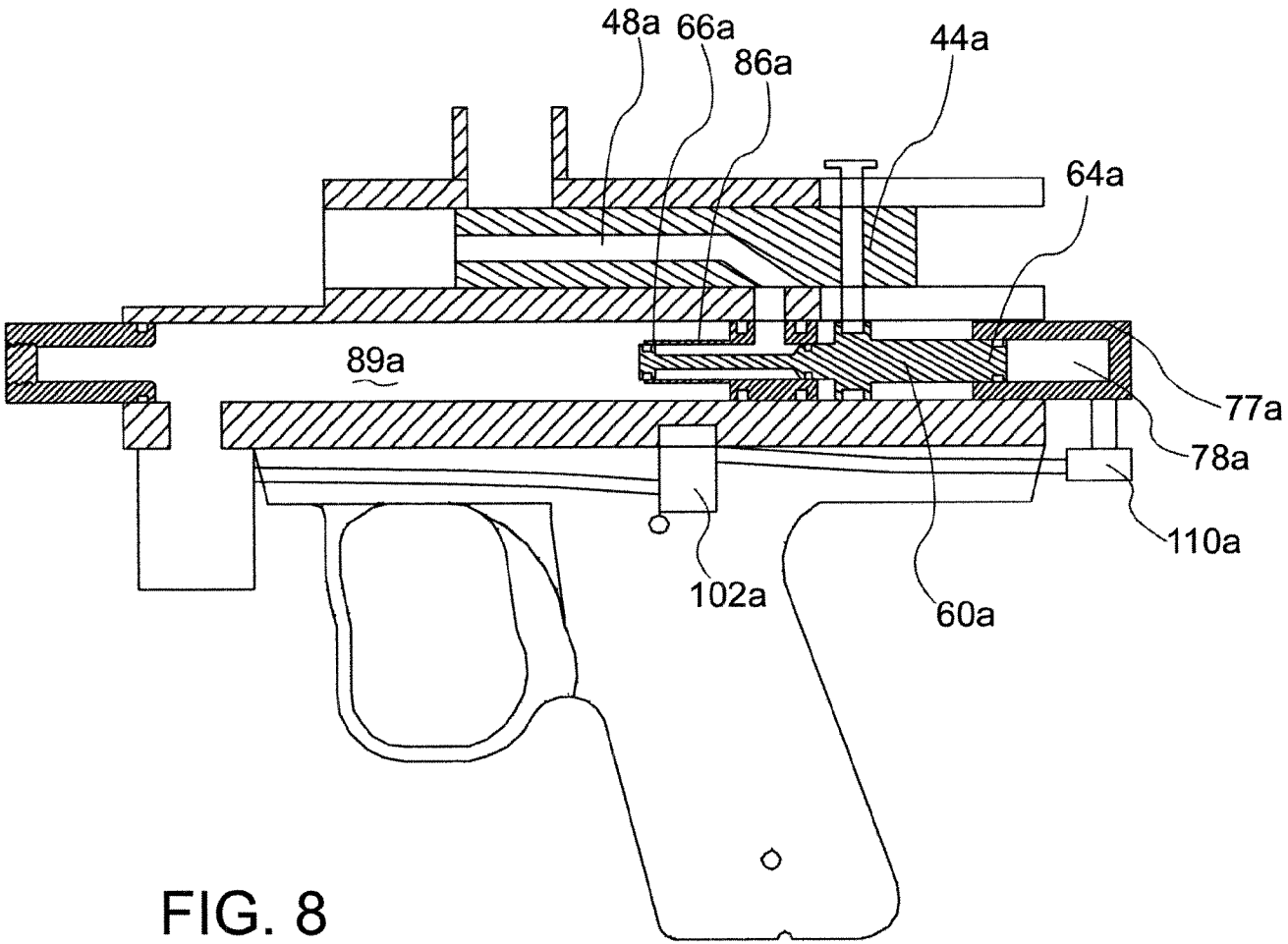
FIG. 8 shows the paintball marking system transitioning back to a loading orientation.

After the actuating chamber 78*a* has positioned in the firing orientation to let a sufficient amount of compressed gas within the dump chamber 89*a* vent to the bolt assembly 26*a*, the piston 60*a* now returns rearwardly as shown in FIG. 8. In one form, either the trigger switch 102*a* or the quick-release valve 110*a* releases pressure within the actuating chamber 78*a*, either by way of a time duration or possibly other methods such as dictating the release of pressure within the actuating chamber 78*a* correlating to the position of the piston 60*a*. In other words, in one form, the actuating ram 64*a* could, for example, pass by a port positioned on, for example, the actuating body 77*a*. As further shown in FIG. 8, the valve ram 66*a* is now resealing with the chute region 86*a* to seal the dump chamber 89*a* from the gas passageway 48*a* of the bolt member 44*a*. After a brief period of time, the piston 60*a* returns back to the loading orientation as shown FIG. 5, and another paintball with the feed chamber 40*a* is fed to the front portion of the bolt at the paintball receiving location 45*a*. It should be reiterated that from the moment that the trigger switch 102*a* is activated and alters the pressure within the trigger line 106*a*, the entire cycling time to reorientate the bolt assembly 26*a* and the spool assembly 24*a* is approximately. A generally broad range for cycle times, in one form, is between 1/10-1/30 of a second. Of course, cycle time depends on a multitude of factors such as the operating pressures, the mass of the various units, and the various surface areas that are utilized. Of course in the broader range, this could be expanded to 50% beyond these range values.

In an alternative form, the first low pressure within the actuating chamber 78*a* in FIG. 5 can be higher than atmospheric, where the release valve mechanism such as a quick-release valve 110*a* (or essentially a mechanism within the trigger system 28*a*) increases the pressure within the actuating chamber 78*a* such as that shown in FIG. 6, which in one form may be the same pressure as in, for example, the dump chamber 89*a*, which is the pressure of the high-pressure source which is attached at the compressed gas receiving area 34*a*. However, there are a multitude of orientations where, for example, in one form the surface area of the actuating ram chamber surface 70*a* could be very large with respect to the surface area of the valve ram dump surface 80*a* (which is the pressure effective surface area thereof as described above), so the pressure differentials multiplied by the surface area differentials bias the piston 60*a* from the loading orientation to the firing orientation (i.e. from FIG. 5 to FIG. 7).

With the above paragraph in mind, it can now be appreciated that the general concept of manipulating the pressure effective surface areas of the piston with various rams in communication with actuating chambers and the dump chamber can be arranged in a variety of pressure effective surface areas and pressure differentials to actuate the piston, which in turn actuates the bolt assembly. There will now be additional embodiments disclosed to illustrate by way of example. Various additional configurations of the actuating chamber and other components to reposition the paintball marking system 20 from the loaded orientation to the firing orientation and vice versa.

Figure 9:
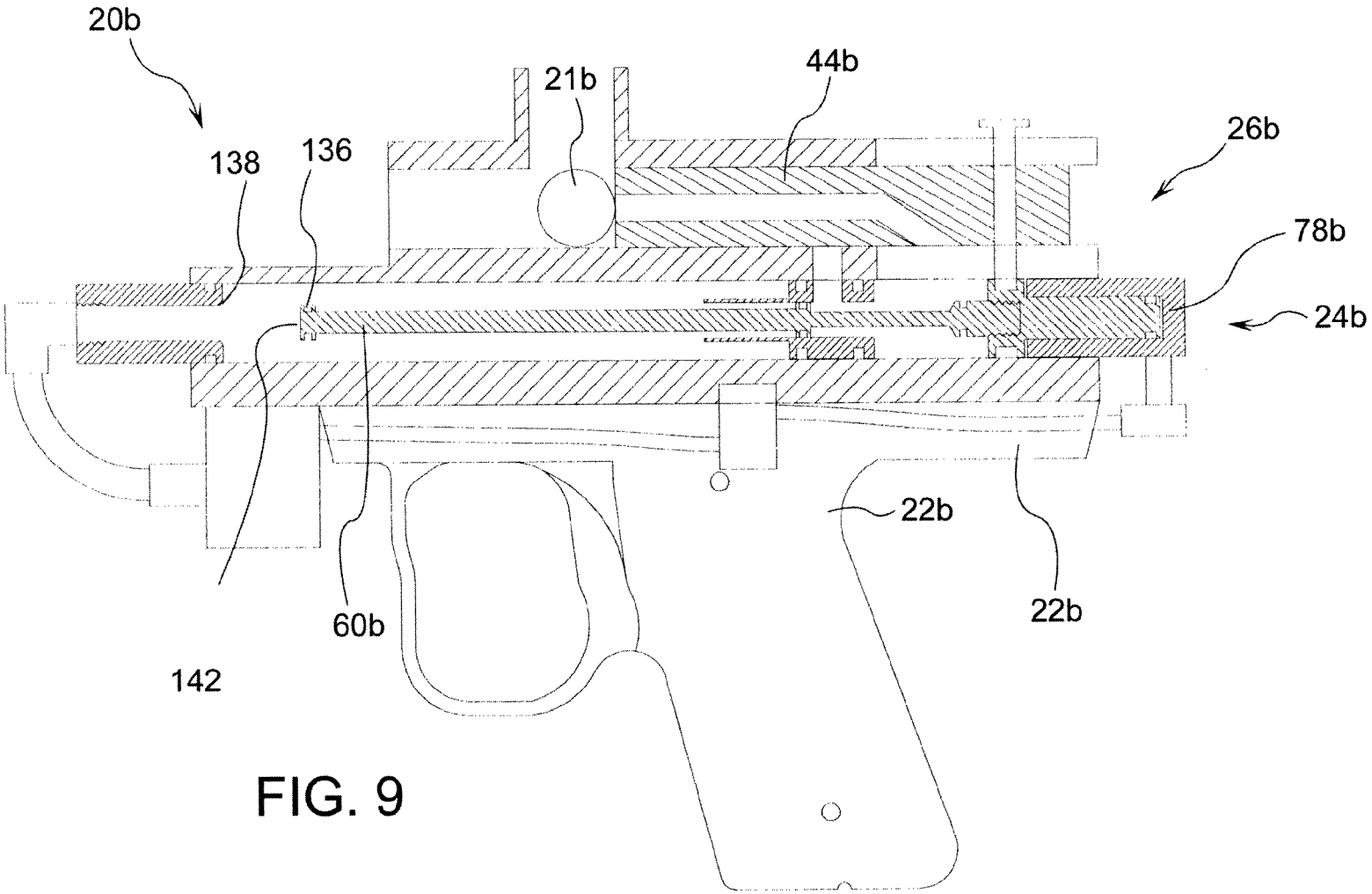
FIG. 9 shows another embodiment of the paintball marking system in a loading orientation.
Figure 10:
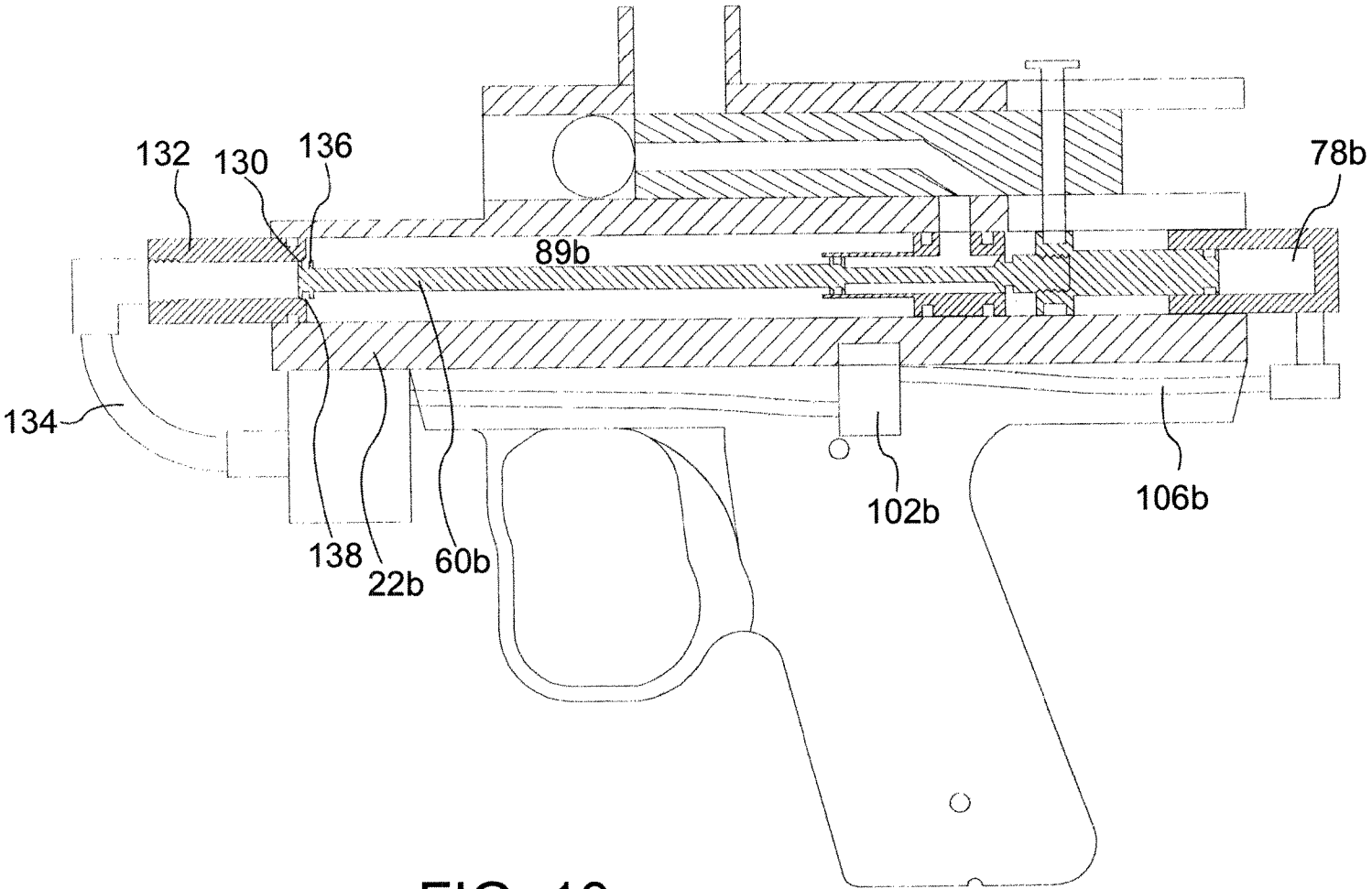
FIG. 10 shows the paintball marking system transitioning from a loading orientation to a firing orientation.
Figure 11:
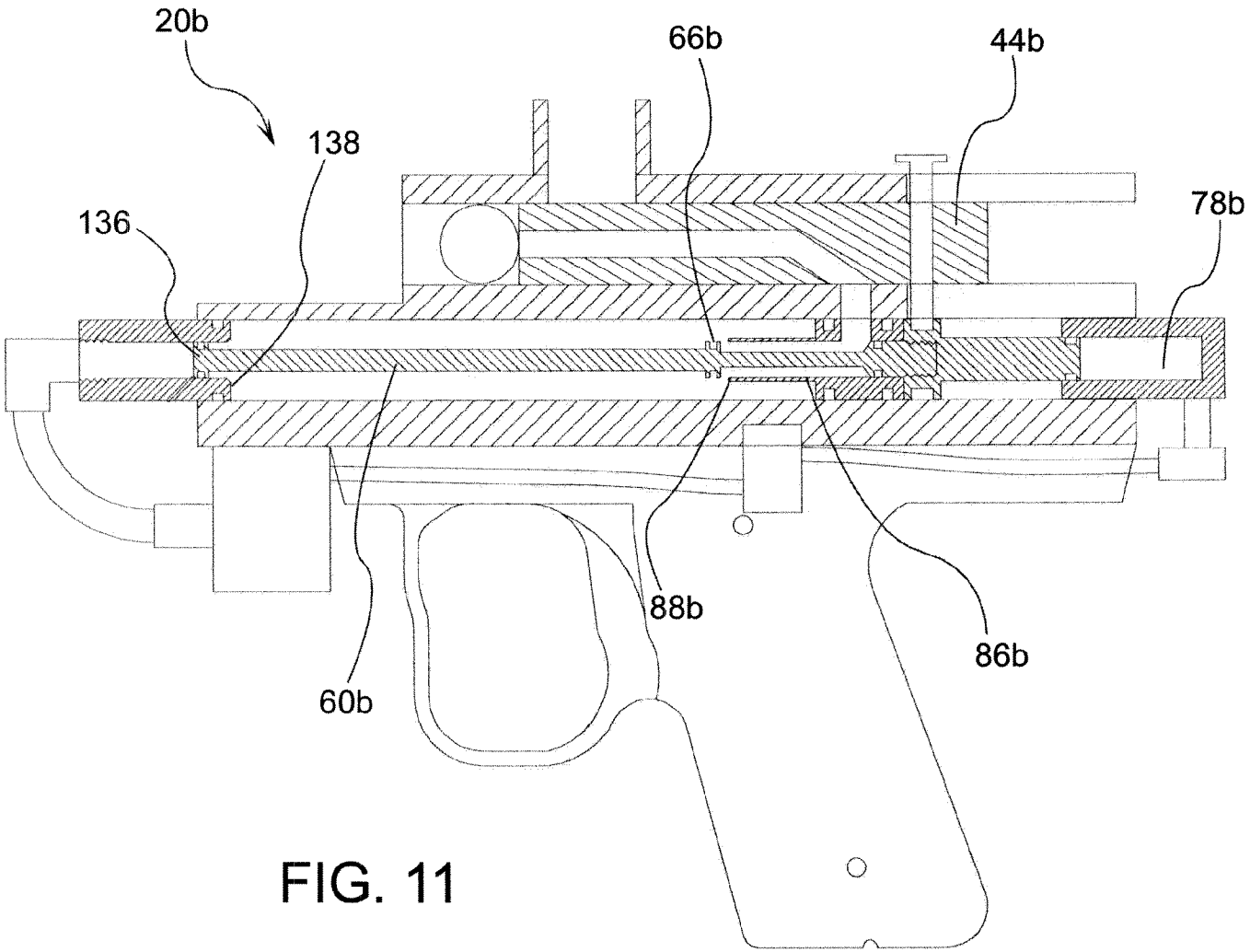
FIG. 11 shows the system in a firing orientation.
Figure 12:
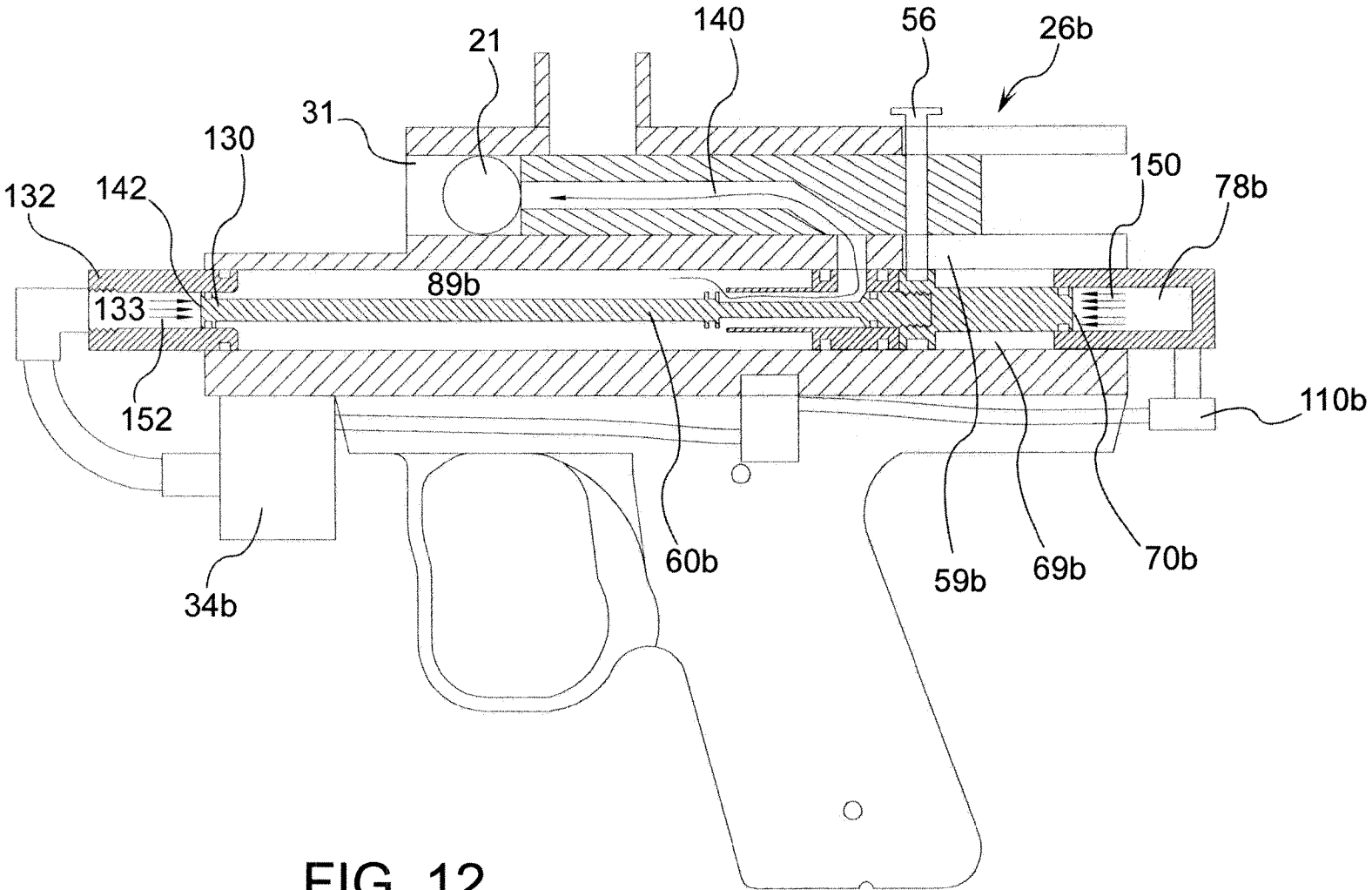
FIG. 12 shows the air passage from the dump chamber to the bolt assembly and further illustrates the pressure vectors acting upon the piston.

Now referring to FIG. 9, there is shown another paintball marking system 20*b* where this embodiment illustrates its operating principles in FIGS. 9-12. As shown in FIG. 9, the actuating chamber 78 is similar to the actuating chamber shown in the second embodiment described above with reference to FIGS. 5-8, where in the loading orientation the pressure within the actuating chamber is at a first low pressure. When the trigger switch 102*b* is activated and the trigger line 106*b* supplies pressure to the actuating chamber 78*b*, the piston 60*b* is repositioned toward the firing orientation. In the embodiment shown in FIGS. 9-12, the cut off ram 130 engages the cut off tube where the high-pressure source communication line 134 feeds compressed gas to the dump chamber 89*b* through the cut off tube 132. As shown in FIG. 10, the annular seal portion 136 is just engaging the end tube lip 138 of the end tube 132. The end tube 132 can be integral with the frame 22*b*, or a separate component fitted to the front portion of the dump chamber 89*b*, such as that shown in FIGS. 9-12. Now referring to FIG. 11, it can be appreciated how the valve ram 66*b* is now disengaged with the chute lip 88 of the chute region 86*b*. As shown in FIG. 12, the vector 140 indicates the gas passageway to allow the compressed gas within the dump chamber 89*b* to communicate with the longitudinally rearward portion of the projectile 21 to accelerate it along the firing tube 31. As further illustrated in FIG. 12, the second high pressure within the actuating chamber 78*b* multiplied by the actuating ram chamber surface 70*b* is greater than the cut off surface 142 of the cut off ram 130 multiplied by the pressure within the cut off tube 132 defining a cut off tube chamber 133. In one form, the pressure within the cut off tube chamber 133 is the same pressure as the high pressure source attached at the compressed gas receiving area 34*b*, and the pressure within the actuating chamber 78*b*, when dynamically repositioning the piston 60*b* to the firing orientation, is also substantially at the same pressure of the high pressure source, or very close to it given the transient nature of the gas flowing therein. Therefore, assuming the pressures within the chambers 133 and 78*b* are substantially equal, as shown by the vectors 150 and 152, there is a greater amount of pressure effective surface area within the actuating chamber 78*b* to bias the piston to the firing position, which in the case of FIG. 12 is biasing the piston to the left. Immediately after the gas within the dump chamber 89*b* has passed to the firing tube 31 of the bolt assembly 26*b*, the pressure within the actuating chamber 78*b* is lowered so that the value of the actuating ram chamber surface 70*b* multiplied by the pressure in the actuating chamber 78*b* is a lower sum than the pressure within the chamber 133 multiplied by the cut off surface 142. Again, in one form, the pressure within the actuating chamber 78*b* is vented to atmospheric pressure by way of the quick-release valve 110*b*. It should be reiterated that the connector travel region 69*b* is not under pressure and is basically vented to atmospheric pressure. Because the connector 56 (see FIG. 2) travels longitudinally forward and rearward, the connector travel region 69*b* needs a certain amount of longitudinal open space to reposition, and this open space provides a conduit to the surrounding atmosphere from the connector travel region 69*b*.

Figure 13:
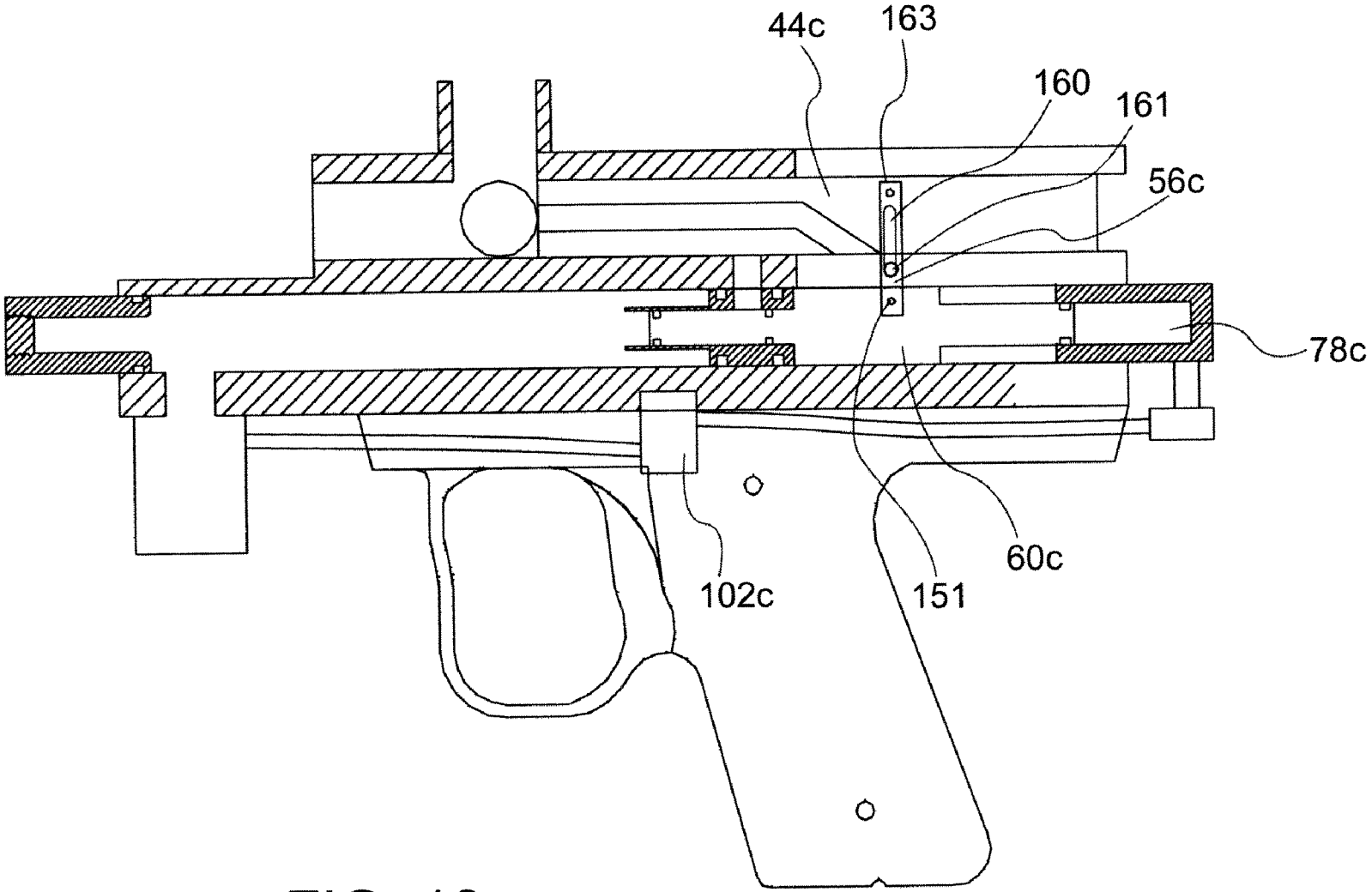
FIG. 13 shows another embodiment where the connector member is a linkage like assembly.

Now referring to FIG. 13, there is shown another embodiment where in general, the piston 60*c* repositions longitudinally rearwardly from the loading orientation to the firing orientation, and is further operationally arranged to move in conjunction with the bolt member 44*c*, which repositions from the longitudinally rearward portion to the forward portion from the loading orientation to the firing orientation. In other words, the piston 60*c* will move in the opposite direction as the bolt member 44*c*, and the lever mechanism connector 56 transfers energy from the motion of the piston 60*c* to the bolt member 44*c*.

The actuating chamber 78*c* is shown with a first high pressure of compressed gas therein. The connector 56 is vividly attached at the piston pivot location 151 and is further pivotally connected at the bolt pivot connection. Further, a frame connection region is provided to allow a pivot-like action of the connector 56*c*. Therefore, in one form, to reposition the piston 60*c* from the loading orientation as shown in FIG. 13, pressure is released within the actuating chamber 78*c* by way of the trigger switch 102*c*, and as the piston 60*c* repositions to the right, the connector slot 160 slides about the pin 161 of the piston pivot location 151, and a pin 163 slides along the vertically orientated slot (not shown) within the bolt member 44*c*. Of course, a multitude of lever-like connectors could be employed.

Figures 14, 15:
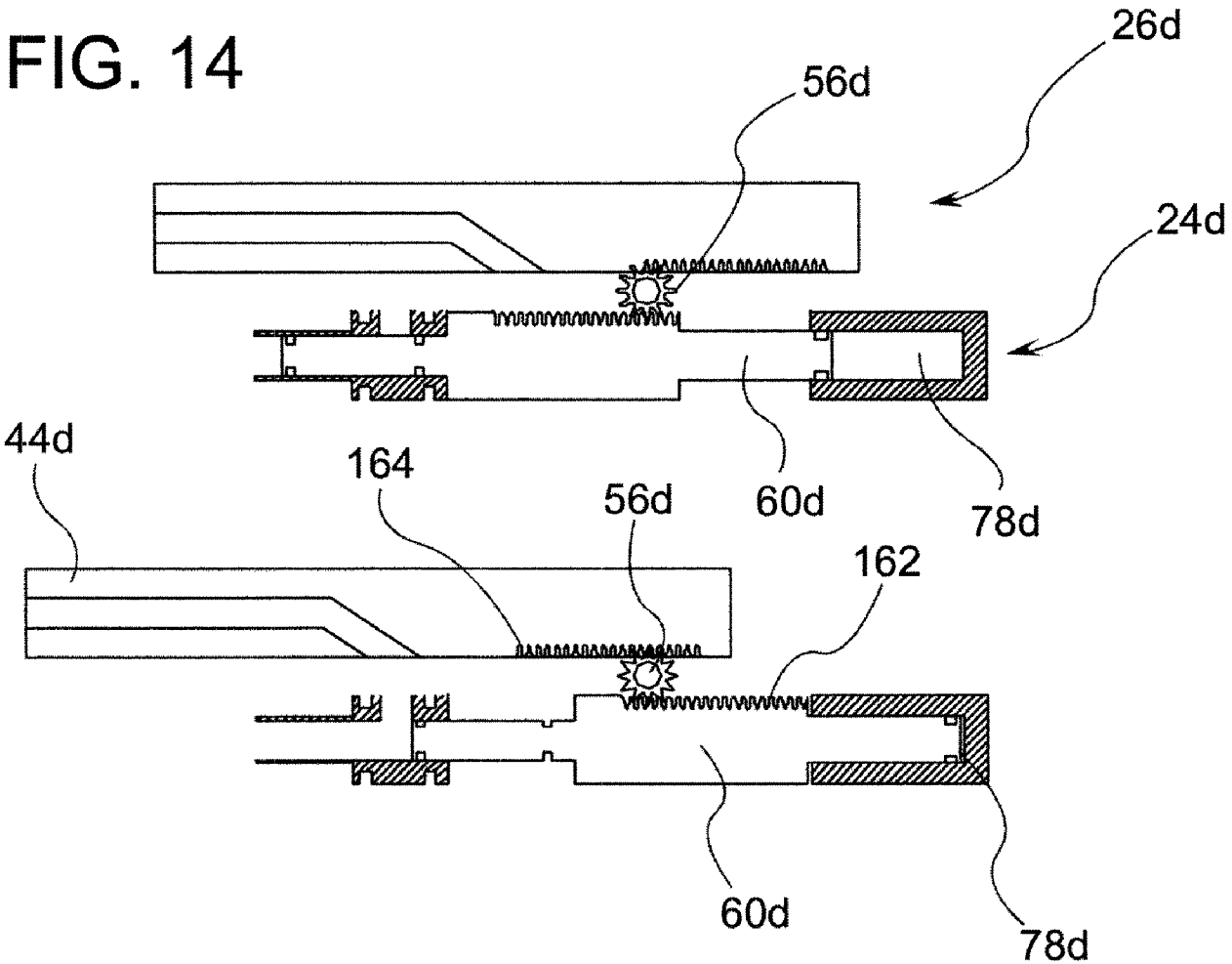
FIG. 14 shows another embodiment where a connector member is a wheel engaging gear like member on the bolt and piston.
FIG. 15 shows the embodiment of FIG. 14 in a firing orientation.

Now referring to FIGS. 14 and 15, there is shown another embodiment having a similar concept as noted above with reference to FIG. 13, where the bolt assembly 26*d* is operationally arranged to move in conjunction with the spool assembly 24*d* by moving in opposite longitudinal directions. As shown in FIG. 14, there is a schematic view of the bolt assembly 26*d* and the spool assembly 24*d* where in this form, the actuating chamber 78*d* is a first high pressure and the assemblies are in a loading orientation. To reposition the assemblies to a firing orientation, pressure is released within the actuating chamber 78*d*, and the piston 60*d* repositions longitudinally rearwardly as shown in FIG. 15. The connector 56*d* in one form is a sprocket member attached to the frame, and the piston track gears 162 transfer torque through the sprocket to the bolt track gears 164, and the bolt member 44*d* repositions longitudinally forwardly.

Figure 16:
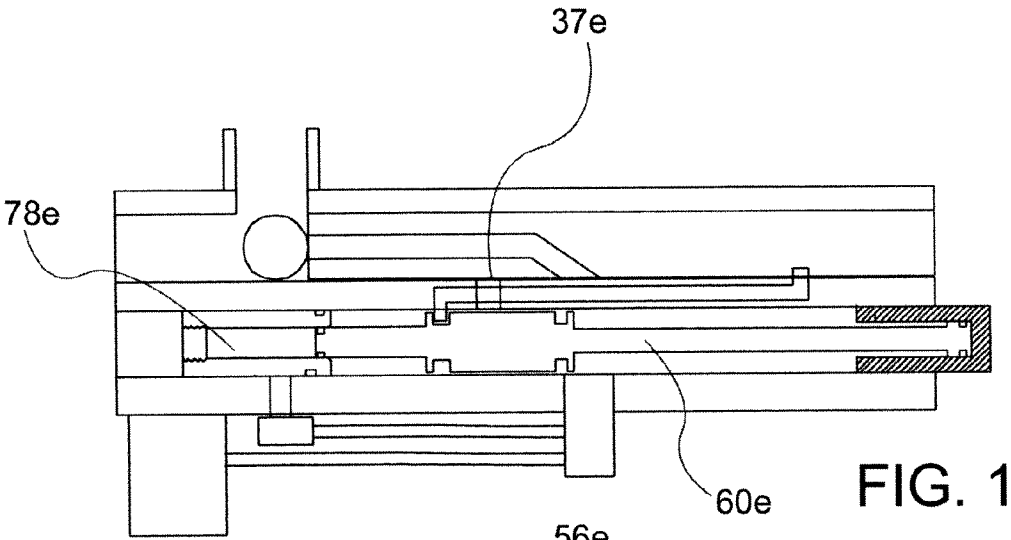
FIG. 16 shows another embodiment in a loading orientation.
Figure 17:
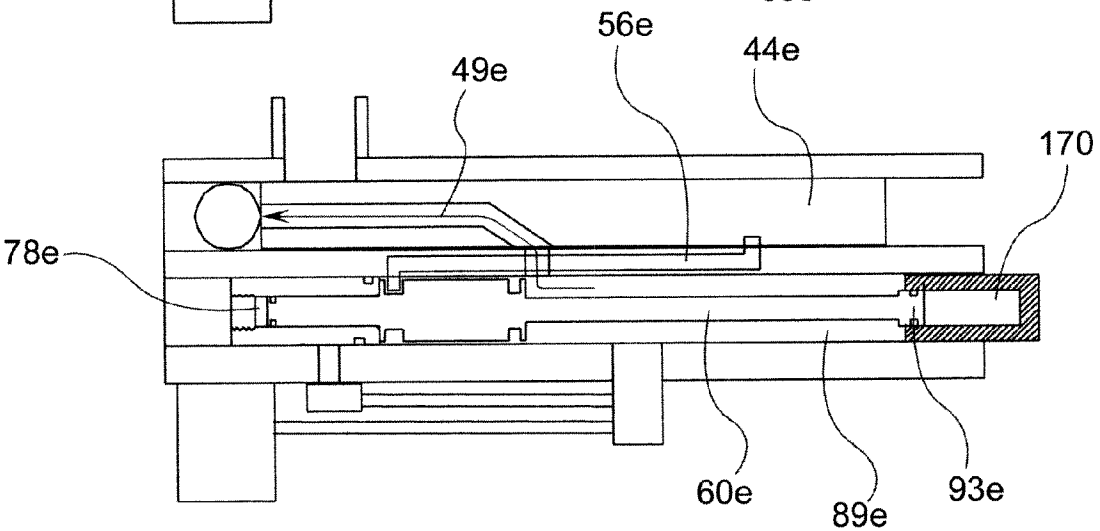
FIG. 17 shows the embodiment of FIG. 16 in a firing orientation.

Now referring to FIG. 16, there is shown another embodiment where the dump chamber 89*e* is positioned longitudinally rearwardly with respect to the frame passageway 37*e*. The actuating chamber 78 is show in a loading orientation in FIG. 16. As the trigger mechanism releases pressure within the actuating chamber 78, the piston 60*e* repositions longitudinally forwardly, and the connector 56*e* translates the motion to operationally arrange the piston and bolt members to move in conjunction with another. The seal ram 93*e* engages the seal chamber 170. In one form, the sealed chamber 170 can be in communication with the trigger system to pressurize a second actuating chamber. An embodiment similar to this concept is shown below with reference to FIGS. 20 and 21.

Figure 18:
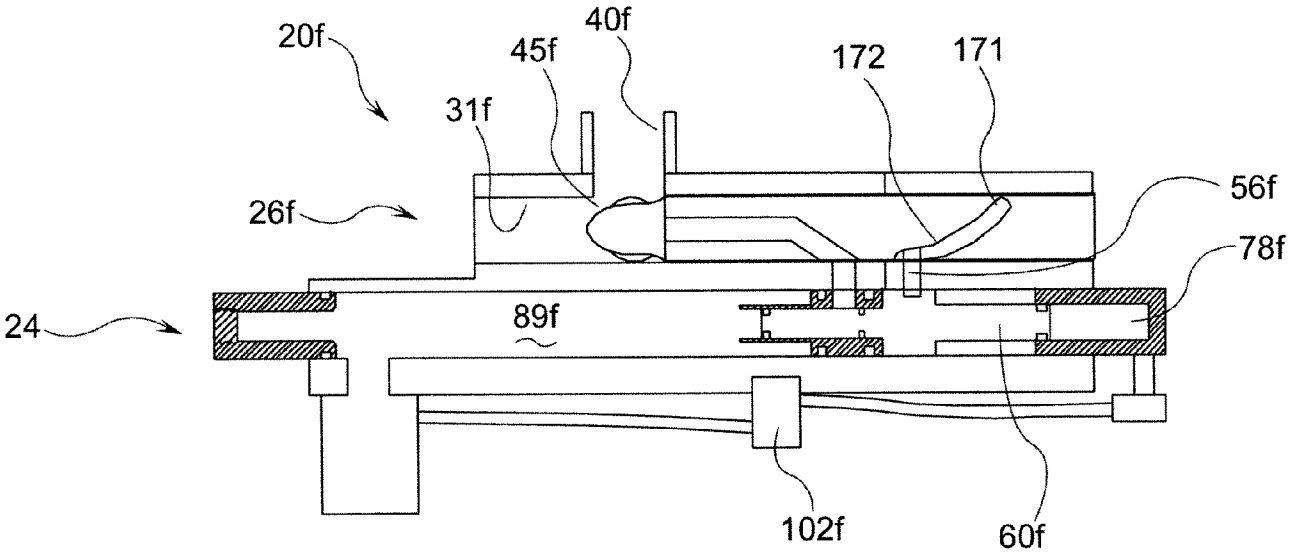
FIG. 18 shows another embodiment having a rotating-type bolt.
Figure 19:
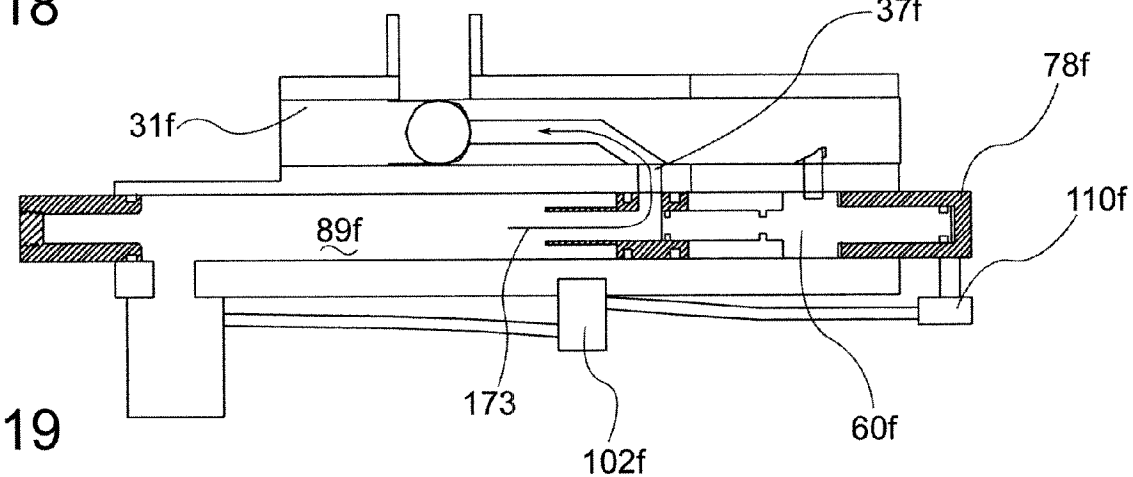
FIG. 19 shows the embodiment of FIG. 18 in a firing orientation.

Now referring to FIGS. 18 and 19, there is another embodiment of the paintball marking system 20*f*. In this embodiment, the bolt assembly 26*f* and the spool assembly 24*f* are operationally arranged to move in conjunction with one another where the bolt rotates substantially about the longitudinal axis to allow the paintball receiving location 45*f* to be positioned to communicate with the feed chamber 40*f* as shown in FIG. 18, and rotate in a manner so that the feed chamber 40*f* is sealed from the firing tube 31*f*.

The spool assembly 24*f* is similar in concept with the previous embodiments, where in this form, the actuating chamber 78*f* is pressurized while in the loading orientation as shown in FIG. 18, and the trigger switch 102*f* is operationally configured to allow the quick-release valve 110*f* to allow the pressure within the actuating chamber 78*f* to vent to atmospheric pressure (or a second low pressure), and the piston 60*f* repositions (in this case, longitudinally rearwardly). The connector 56*f* is operationally configured to be received within the torque slot 171 defined by the slot surface 172 on the bolt member 44*f*. As shown in FIG. 19, the piston 60*f* repositions longitudinally rearwardly and the bolt member 44*f* rotates in a manner to seal the firing tube 31*f* from the feed chamber 40*f*, and the gas passageway 48*f* of the bolt member 44*f* is in communication with the frame passageway 37*f*, and the arrow 173 shows the communication passage of the compressed air within the dump chamber 89*f*. Of course, it could be appreciated that the spool assembly 24*f* could be arranged in a manner where the actuating chamber 78*f* is positioned longitudinally forwardly of the frame passageway 37*f*.

Figure 20:
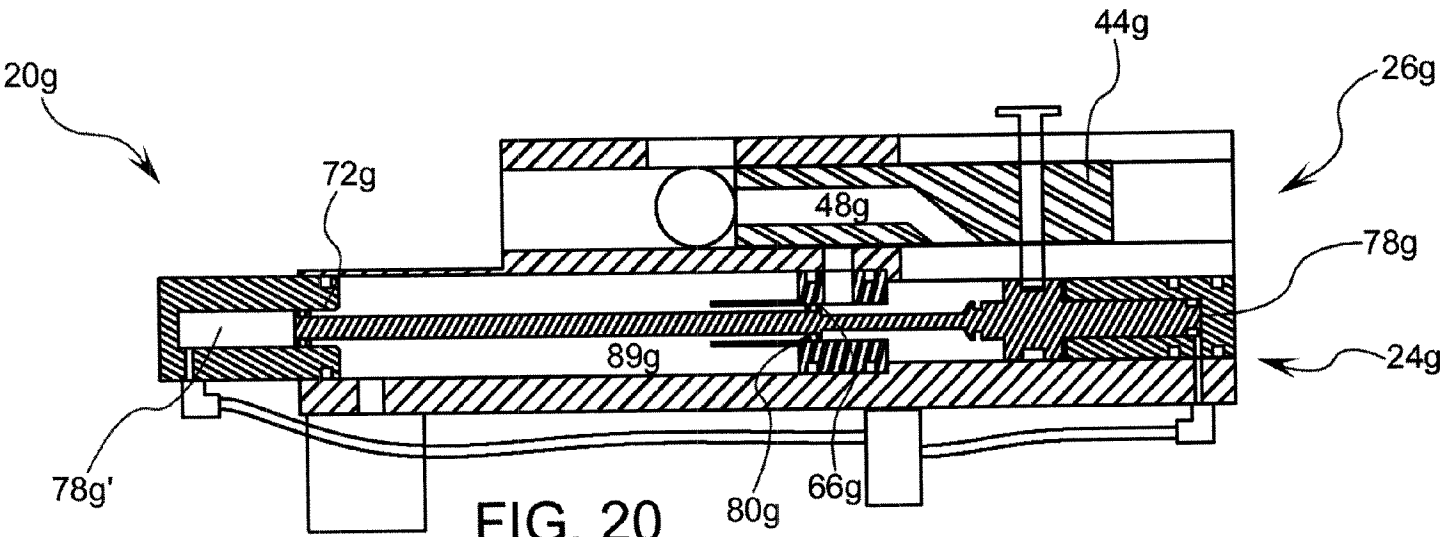
FIG. 20 shows another embodiment having two actuating chambers.

Now referring to FIGS. 20 and 21, there is shown another embodiment where the paintball marking system 20*g* comprises the first actuating chamber 78*g* and the second actuating chamber 78*g*'. In this form, the pressurized gas within the dump chamber 89*g* is released to the gas passage 48*g* by altering the pressure within the first and second actuating chambers. Essentially, the trigger switch 102*g* would vent the pressure within the actuating chamber 78*g*' and pressurize the actuating chamber 78*g* to reposition the bolt member 60*g* to the firing orientation such as that shown in FIG. 21. Therefore, for definition purposes, the first and second actuating chambers could effectively be either the chamber 70*g* or 78*g*'. Of course, the bolt assembly 26*g* and the spool assembly 24*g* can be operationally arranged to move in conjunction with one other in other forms such as those shown in previous embodiments, and the various forms of repositioning the piston can be rearranged with other forms of operationally organizing the piston and bolt member to move in conjunction with one other from the loading orientation to the firing orientation.

It should be further noted that in another form, a modification can be provided similar to the embodiment shown in FIGS. 20 and 21 where the second actuating chamber 78*g*' would have the second actuating ram dump surface 72*g* be a smaller diameter than the valve ram dump surface 80*g*, and the second actuating chamber 78*g* would in fact not be an actuating chamber, but rather be vented to atmospheric, and the pressure within the dump chamber 89*g* would provide a longitudinal forward thrust to dampen out the rearward travel following firing of the projectile after the firing orientation as shown in FIG. 21.

Now referring to FIGS. 22-25, there is shown another embodiment which is similar to the first embodiment shown in FIGS. 1-4, with the exception that this embodiment utilizes a low pressure regulator 180 to reduce the pressure within the actuating chamber 78*h*. As shown to FIGS. 22-25, the paintball marking system 20*h* has very similar components to the first embodiment, except the trigger system 28*h* employs the low pressure regulator 180 which maintains a first high pressure which is less than the available pressure of the high pressure source (not shown) which is connected at the compressed gas receiving area 34*h*. Therefore, it can be appreciated that the actuating ram chamber surface 70*h* of the actuating ram 64*h* multiplied by the first high pressure within the actuating chamber 78*h* is greater than the pressure effective surface areas of the actuating ram dump surface 72*h* subtracted by the valve ram dump surface 80*h*, and that sum multiplied by the pressure within the dump chamber 89*h*. In other words, utilizing the schematic pressure vectors as shown in FIG. 23, the amount of surface area the vectors 120*h* cover upon the actuating ram chamber surface 70*h* is much greater than the pressure vectors 116*h* subtracted by the pressure vectors 118*h*. Therefore, for example, if the surface area of the actuating ram chamber surface 70*h* is ¾ of a square inch and the pressure effective surface area within the dump chamber 89*h* is ⅛ of a square inch (i.e. the pressure effective surface area 72*h* subtracted by the surface 80*h*), then the pressure within the actuating chamber 78*h* can in theory be ⅙ of the pressure within the dump chamber 89*h* for the piston 60*h* to be in pneumatic balance. Therefore, if the pressure within the actuating chamber is, for example, ⅓ of the pressure of that as the dump chamber 89*h*, then there is sufficient actuating force to maintain the piston 60*h* in the loading orientation, such as that shown in FIGS. 22 and 23. One advantage of having the low pressure regulator 180 providing a lower first high pressure within the actuating chamber 78*h* is that there is less wear on any type of solenoid valve within the trigger switch 102*h*.

Now referring to FIG. 24, it can be seen how the quick-release valve 110*h* has released the compressed gas within the actuating chamber 78*h*, and the imbalance of the surface area between the surfaces 72*h* and 80*h* biases the piston 60*h* to the left in FIG. 24. As shown in FIG. 25, the assembly is in the firing orientation, and the arrow 49*h* shows the gas passage communication of the dump chamber 89*h* to the projectile 21*h*.

With regard to FIGS. 22-25, the surfaces 70*h* can be of a diameter 0.40 of an inch in diameter, which equates to 0.1256 in^2, and diameter of the surface 80*h* is approximately 0.3125 inches which is 0.0767 in^2. Therefore, even with the low pressure regulator 180 to lower the pressure of the actuating chamber, with these surface area differentials (shown by way of one as example), the unit will operate and cycle from the loading to firing orientations.

In the broader scope, the various mechanisms described above, such as the bolt assembly 26 and the spool assembly 24, could possibly be utilized for other projectiles 21 such as tennis balls, a potato guns, darts, compressed and rolled-up shirts, or novelty items such as launching pumpkins, confetti or the like.

Figure 26:
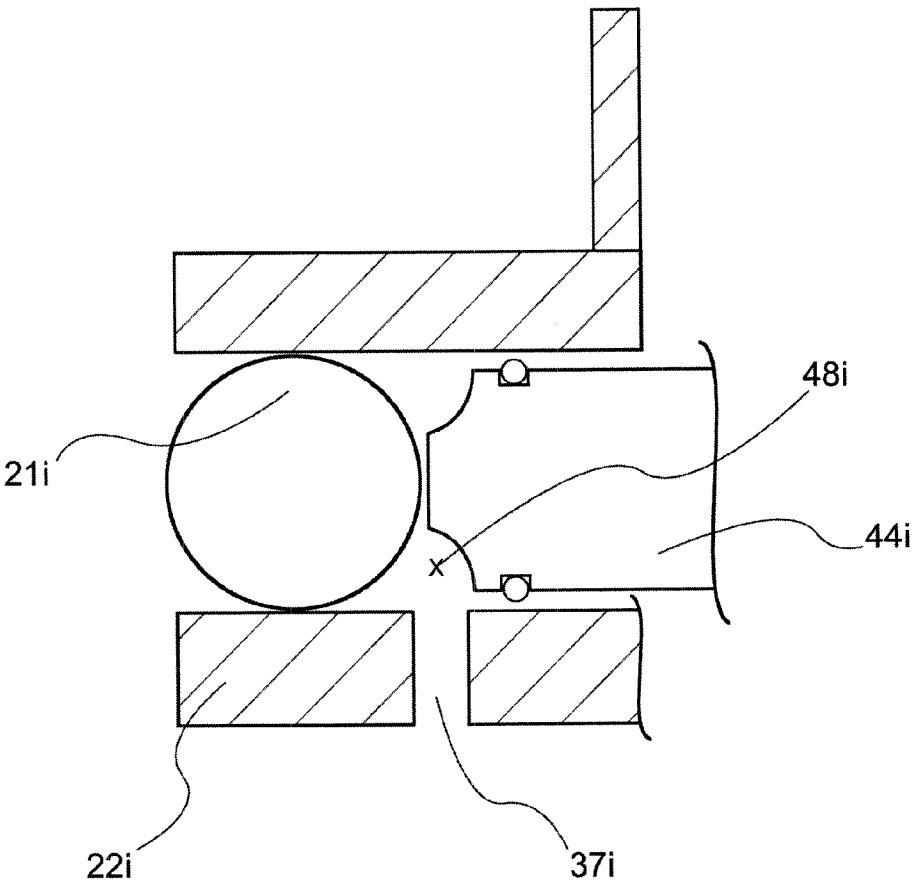
FIG. 26 shows another variation of a bolt passageway showing another example of how to communicate compressed gas from the dump chamber to the rearward portion of the paintball projectile.

It should further be noted that the gas passage which is shown as 48 in the various embodiments above, could be in a variety of forms such as that as shown in FIG. 26 as 48*i*. For example, it could be a longitudinally forward surface of the bolt member 44*i*, where when the bolt assembly is in the firing orientation and the projectile 21*i* is positioned in a more forward orientation, a conduit releasing air therethrough, such as the frame opening 37*i*, would be positioned adjacent just behind the paintball projectile 21*i* to provide thrust thereto. Therefore, the passage would not necessarily be an enclosure within the bolt, but would provide enough surface area exposed by the projectile in the rearward longitudinal direction to allow gas to be in contact therewith to accelerate the projectile.

Of course various embodiments are shown above that illustrate the basic concept of the teachings of the invention. course, further embodiments could be utilized where for example the piston 60 above of was does not necessarily need to move along longitudinal direction of the unit but for example code of your ranged in the to reposition the vertical direction. While the present invention is illustrated by description of several embodiments and while the illustrative embodiments are described in detail, it is not the intention of the applicants to restrict or in any way limit the scope of the appended claims to such detail. Additional advantages and modifications within the scope of the appended claims will readily appear to those sufficed in the art. The invention in its broader aspects is therefore not limited to the specific details, representative apparatus and methods, and illustrative examples shown and described. Accordingly, departures may be made from such details without departing from the spirit or scope of applicant's general concept.

I claim:

1. A paintball marker system operationally configured to fire a paint ball with pressurized gas from a pressurized gas source, the paintball marker system comprising:

a) a frame having a bolt assembly housing region and a spool assembly housing region, the frame further having a actuating chamber surface defining in part an actuating chamber, b) a spool assembly comprising a piston having an actuating ram and a valve ram, the actuator ram having an actuating ram chamber surface which in part defines the actuating chamber, the valve ram positioned within a valve body and having a valve ram dump surface defining in part a dump chamber that is operatively arranged to be in communication with a high-pressure source, the actuating ram and the valve ram being connected to one another on the piston and both move substantially synchronously with respect to one another, c) a bolt assembly comprising a bolt member having a paintball receiving location, the bolt assembly having a gas passage to communicate with pressurized gas from the dump chamber, d) a firing system comprising a trigger switch having a trigger line in communication with the actuating chamber, e) whereas the spool assembly and the bolt assembly are operatively arranged to move in conjunction with one another where the paintball marker system has a loading orientation where the paintball receiving location is orientated to allow a paintball to be positioned thereby and the bolt assembly does not have gas pressure from the pressurized gas source when in the loading orientation, the valve ram dump surface having a pressure effective surface area which has pressure applied thereto by the pressure within the dump chamber which is higher than atmospheric pressure, and whereby a change of pressure in the actuating chamber by changing the pressure within the trigger line by the trigger switch biases the piston from a loading orientation to a firing orientation where the valve ram is disengaged from the valve body and pressure from within the dump chamber is in communication with the gas passage of the bolt assembly to accelerate, and f) the actuating ram has an actuating ram dump surface and where the actuating ram dump surface and the valve ram dump surface define in part a dump chamber and the actuating ram dump surface and the valve ram dump surface have pressure effective surface areas which both have pressure applied thereto by the pressure within the dump chamber which is higher than atmospheric pressure, and whereby a change of pressure in the actuating chamber biases the valve ram to disengage from the valve body and pressurized gas from within the dump chamber is in communication with the gas passage of the bolt assembly to accelerate the paint ball.

2. The paintball marker system as recited in claim 1 where the actuating chamber is at atmospheric pressure during the loading orientation, and the trigger switch pressurizes the actuating chamber where the pressure acting upon the actuating ram of the piston is sufficient to reposition the piston to a firing orientation.

3. The paintball marker system as recited in claim 2 where the pressure affected surface area of the valve ram dump surface of the valve ram of the piston is less than the pressure affected surface area of the actuating ram dump surface of the actuating ram and when the paintball marker system is in a loading orientation, the actuating chamber is pressurized above atmospheric, and a trigger switch which is operated by a firing mechanism reduces the pressure within the actuating chamber to position the piston from the loading orientation to the firing orientation.

4. The paintball marker system as recited in claim 3 where the trigger switch is in communication with a trigger line which is connected to a quick release valve interposed between the actuating chamber and the trigger line, whereby when the trigger line reduces pressure, the quick release valve dumps the compressed air within the actuating chamber at an accelerated rate.

5. The paintball marker system as recited in claim 4 where the quick release valve dumps the air through the actuating chamber from the high-pressure state to substantially atmospheric pressure at less than 1/10th of a second.

6. The paintball marker system as recited in claim 2 where the actuating chamber is at a first low pressure when in the loading orientation, and the trigger switch is optimally configured to pressurize the actuating chamber to a second high pressure whereby the second high pressure multiplied by the actuating chamber surface of the actuating ram is greater than the valve ram dump surface of the valve ram of the piston multiplied by the dump chamber pressure to reposition the ram from the loading orientation to the firing orientation.

7. The paintball marker system as recited in claim 6 where the second high pressure within the actuating chamber is substantially the same as the pressure within the dump chamber.

8. The paintball marker system as recited in claim 2 where the actuating ram dump surface of the actuating ram of the piston multiplied by the pressure within the dump chamber in a loading orientation is greater than the sum of a pressure effective surface area of the valve ram dump surface of the valve ram and the actuating chamber surface of the actuating ram multiplied by a loading orientation high pressure within the actuating chamber.

9. The paintball marker system as recited in claim 8 where the loading orientation high pressure of the actuating chamber is substantially the same as the dump chamber pressure when the paintball marker system is in a loading orientation.

10. The paintball marker system as recited in claim 8 where the loading orientation high pressure of the actuating chamber is less than the pressure within the dump chamber when the paintball marker system is in a loading orientation.

11. The paintball marker system as recited in claim 10 where the loading orientation high pressure of the actuating ram when in a loading orientation is less than one half of the pressure within the dump chamber when in a loading orientation, and a pressure regulating valve maintains the loading orientation high pressure and the pressure regulating valve is in communication with the high pressure source.

12. The paintball marker system as recited in claim 2 where no portion of the bolt assembly is pressurized when in a loading orientation.

13. The paintball marker system as recited in claim 1 where the bolt assembly and the spool assembly are positioned longitudinally rearward with respect to the frame when in a loading orientation, and the bolt assembly and the spool assembly are positioned in a longitudinally forward position when in a firing orientation.

14. The paintball marker system as recited in claim 13 where a high pressure source communication line is positioned in a forward region of the frame and the piston further comprises a cut-off ram which is properly configured to engage a cut-off tube to isolate the dump chamber from the high-pressure source when the piston is in a firing orientation.

15. The paintball marker system as recited in claim 1 where the dump chamber is not sealed from the pressurized gas source when the spool assembly is in a firing orientation.

16. The paintball marker system as recited in claim 1 where the actuating ram is positioned longitudinally forward of the valve ram of the piston.

17. The paintball marker system as recited in claim 1 where the valve ram extends beyond a chute region of the valve body be on a chute lip to allow communication between the dump chamber at a frame passageway interposed between the bolt assembly and the spool assembly, which provides communication of compressed gas within the dump chamber to the gas passageway of the bolt.

18. The paintball marker system as recited in claim 17 where the dump chamber is positioned rearwardly of the frame passageway.

19. The paintball marker system as recited in claim 1 where the bolt assembly and the spool assembly are operatively arranged to move in conjunction with one another from the loading orientation to the firing orientation where the bolt assembly moves longitudinally forwardly and the spool moves longitudinally rearwardly.

20. The paintball marker system as recited in claim 1 where the bolt assembly and the spool assembly are operatively arranged to move in conjunction with one another whereby a transfer gear translates forward movement in the piston with rearward movement of the bolt.

21. The paintball marker system as recited in claim 1 where the bolt assembly and the spool assembly are operatively arranged to move in conjunction with one another where as the actuating chamber repositions by way of pressure differential of the piston from the loading orientation to the firing orientation by displacing the piston in a longitudinal direction, a bolt pin engaged within a torque slot defined by a slot surface on the bolt rotates a ball receiving location which is in communication with a feed chamber when in the loading orientation, to a rotated position where the ball receiving location of the bolt is cut off in communication from the feed chamber when in a firing orientation, and pressure from the dump chamber is directed to the gas passageway of the bolt member.

22. The paintball marker system as recited in claim 1 where a second actuating chamber is in communication with a second actuating chamber ram and the trigger switch is operatively configured to direct pressure to the first actuating chamber to reposition the piston from the loading orientation to the firing orientation, and the second actuating chamber has a loading orientation pressure which is higher than atmospheric pressure and this pressure is released at the substantially same time as the pressure within the first actuating chamber is increased to reposition the piston from the loading orientation to the firing orientation.

23. The paintball marker system as recited in claim 22 where a second actuating ram dump surface has a pressure effective surface area that is substantially the same as the valve ram dump surface.

24. The paintball marker system as recited in claim 23 where the second actuating ram has a second actuating ram chamber surface that has a substantially similar pressure effective surface area as the actuating ram chamber surface of the actuating ram.

* * * * *